US007591724B2

(12) United States Patent
Baerlocher

(10) Patent No.: US 7,591,724 B2
(45) Date of Patent: Sep. 22, 2009

(54) GAMING DEVICE HAVING A GAME WITH PRIMARY SYMBOLS, SECONDARY SYMBOLS ASSOCIATED WITH THE PRIMARY SYMBOLS AND INDEPENDENTLY GENERATED SECONDARY SYMBOLS

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 440 days.

(21) Appl. No.: 10/957,013

(22) Filed: Sep. 30, 2004

(65) Prior Publication Data

US 2006/0073879 A1 Apr. 6, 2006

(51) Int. Cl.
*A63F 9/24* (2006.01)

(52) U.S. Cl. ..... 463/20

(58) Field of Classification Search ..... 463/20, 463/22, 25

See application file for complete search history.

(56) References Cited

U.S. PATENT DOCUMENTS

| | | | |
|---|---|---|---|
| 1,978,395 | A | 10/1934 | Groetchen |
| 3,420,525 | A | 1/1969 | Waders |
| 3,642,287 | A | 2/1972 | Lally et al. |
| 3,735,987 | A | 5/1973 | Ohki |
| 4,410,178 | A | 10/1983 | Partridge |
| 4,448,419 | A | 5/1984 | Telnaes |
| 4,695,053 | A | 9/1987 | Vazquez, Jr. et al. |
| 4,756,531 | A | 7/1988 | DiRe et al. |
| 4,836,546 | A | 6/1989 | DiRe et al. |
| 4,871,171 | A | 10/1989 | DiRe et al. |
| 5,152,529 | A | 10/1992 | Okada |
| 5,205,555 | A | 4/1993 | Hamano |
| 5,259,616 | A | 11/1993 | Bergmann |
| 5,308,065 | A | 5/1994 | Bridgeman et al. |
| 5,332,228 | A | 7/1994 | Schultz |
| 5,342,049 | A | 8/1994 | Wichinsky et al. |

(Continued)

FOREIGN PATENT DOCUMENTS

| | | | |
|---|---|---|---|
| AU | 199716432 | B2 | 9/1997 |

(Continued)

OTHER PUBLICATIONS

Slot Machines, A Pictorial History of the First 100 Years, Fifth Edition by Marshall Fey.*

(Continued)

*Primary Examiner*—Corbett Coburn
*Assistant Examiner*—Omkar Deodhar
(74) *Attorney, Agent, or Firm*—K&L Gates LLP

(57) ABSTRACT

A gaming device in which primary game symbols are generated in association with secondary symbols. The secondary symbols if generated in a particular combination and in a particular situation, e.g., in association with winning base game symbols, provide a benefit to the player, such as a modification of a payout provided from the base or primary game win. In one embodiment, multiple secondary symbols appearing on slot machine reels are evaluated for a win. In another embodiment, a match between a secondary symbol appearing on slot machine reel and a secondary symbol appearing on a separate secondary reel yields a win. In a third embodiment, a winning combination of at least one secondary symbol appearing on slot machine reel in combination with a secondary symbol appearing on a separate secondary reel yields a win.

66 Claims, 24 Drawing Sheets

U.S. PATENT DOCUMENTS 5,356,140 A * 10/1994 Dabrowski et al. ..... 463/12
5,364,100 A 11/1994 Ludlow et al.
5,393,057 A 2/1995 Marnell, II
5,393,061 A 2/1995 Manship et al.
5,395,111 A 3/1995 Inoue
5,423,539 A 6/1995 Nagao
5,431,408 A 7/1995 Adams
5,449,173 A 9/1995 Thomas et al.
5,524,888 A 6/1996 Heidel
5,531,440 A * 7/1996 Dabrowski et al. ..... 463/12
5,531,441 A 7/1996 Dabrowski et al.
5,536,016 A 7/1996 Thompson
5,542,669 A 8/1996 Charron et al.
5,584,485 A 12/1996 Jone et al.
5,584,764 A 12/1996 Inoue
5,609,524 A 3/1997 Inoue
5,611,535 A 3/1997 Tiberio
5,647,798 A 7/1997 Falciglia
5,722,891 A 3/1998 Inoue
5,752,881 A 5/1998 Inoue
5,772,506 A 6/1998 Marks et al.
5,775,692 A 7/1998 Watts et al.
5,823,873 A 10/1998 Moody
5,823,874 A 10/1998 Adams
5,848,932 A 12/1998 Adams
5,851,148 A 12/1998 Brune et al.
5,863,249 A 1/1999 Inoue
5,882,261 A 3/1999 Adams
5,919,088 A 7/1999 Weiss
5,935,002 A 8/1999 Falciglia
5,980,384 A * 11/1999 Barrie ..... 463/16
5,989,121 A 11/1999 Sakamoto
6,004,207 A 12/1999 Wilson et al.
6,015,346 A 1/2000 Bennett
6,033,307 A 3/2000 Vancura
6,059,289 A 5/2000 Vancura
6,059,658 A 5/2000 Mangano et al.
6,062,979 A 5/2000 Inoue
6,062,980 A 5/2000 Luciano
6,086,066 A 7/2000 Takeuchi et al.
6,089,976 A 7/2000 Schneider et al.
6,089,977 A 7/2000 Bennett
6,102,798 A 8/2000 Bennett
6,105,962 A 8/2000 Malavazos et al.
6,117,009 A 9/2000 Yoseloff
6,120,031 A 9/2000 Adams
6,126,542 A 10/2000 Fier
6,129,355 A 10/2000 Hahn et al.
6,149,521 A 11/2000 Sanduski
6,159,095 A 12/2000 Frohm et al.
6,159,098 A 12/2000 Slomiany et al.
6,186,894 B1 * 2/2001 Mayeroff ..... 463/20
6,190,254 B1 2/2001 Bennett
6,190,255 B1 2/2001 Thomas et al.
6,203,428 B1 * 3/2001 Giobbi et al. ..... 463/16
6,210,279 B1 4/2001 Dickinson
6,213,876 B1 4/2001 Moore, Jr.
6,220,959 B1 4/2001 Holmes, Jr. et al.
6,224,483 B1 5/2001 Mayeroff
6,227,971 B1 5/2001 Weiss
6,251,013 B1 6/2001 Bennett
6,270,412 B1 8/2001 Crawford et al.
6,299,165 B1 10/2001 Nagano
6,299,170 B1 10/2001 Yoseloff
6,302,398 B1 10/2001 Vecchio
6,302,790 B1 10/2001 Brossard
6,311,976 B1 11/2001 Yoseloff et al.
6,315,663 B1 11/2001 Sakamoto
6,319,124 B1 11/2001 Baerlocher
6,322,078 B1 11/2001 Adams
6,328,649 B1 12/2001 Randall et al.
6,336,860 B1 1/2002 Webb
6,347,996 B1 2/2002 Gilmore et al.
6,358,144 B1 3/2002 Kadlic et al.
6,394,902 B1 * 5/2002 Glavich et al. ..... 463/20
6,398,218 B1 6/2002 Vancura
6,398,220 B1 6/2002 Inoue
6,416,406 B1 * 7/2002 Duhamel ..... 463/12
6,419,579 B1 7/2002 Bennett
6,428,412 B1 8/2002 Anderson et al.
6,435,511 B1 8/2002 Vancura et al.
6,439,993 B1 8/2002 O'Halloran
6,439,995 B1 8/2002 Hughs-Baird et al.
6,454,266 B1 9/2002 Breeding et al.
6,461,241 B1 10/2002 Webb et al.
6,471,208 B2 10/2002 Yoseloff et al.
6,494,454 B2 12/2002 Adams
6,533,273 B2 3/2003 Cole et al.
6,533,661 B2 * 3/2003 Sanders ..... 463/20
6,561,904 B2 * 5/2003 Locke et al. ..... 463/25
6,569,015 B1 5/2003 Baerlocher et al.
6,575,830 B2 6/2003 Baerlocher et al.
6,589,114 B2 * 7/2003 Rose ..... 463/20
6,595,854 B2 7/2003 Hughs-Baird et al.
6,604,740 B1 8/2003 Singer et al.
6,616,142 B2 9/2003 Adams
6,616,531 B1 9/2003 Mullins
6,659,864 B2 12/2003 McGahn et al.
6,726,204 B2 4/2004 Inoue
6,780,104 B2 * 8/2004 Fox ..... 463/13
6,866,583 B2 3/2005 Glavich et al.
6,905,406 B2 * 6/2005 Kaminkow et al. ..... 463/20
6,981,917 B2 * 1/2006 Webb et al. ..... 463/16
7,000,921 B2 * 2/2006 Schultz ..... 273/292
7,014,560 B2 * 3/2006 Glavich et al. ..... 463/20
7,137,888 B2 * 11/2006 Glavich et al. ..... 463/20
7,169,042 B2 * 1/2007 Muir et al. ..... 463/16
7,371,171 B1 5/2008 Englman et al.
2002/0142829 A1 10/2002 Inoue
2002/0155882 A1 * 10/2002 Baerlocher et al. ..... 463/20
2002/0198042 A1 * 12/2002 Webb et al. ..... 463/20
2003/0040355 A1 2/2003 Baerlocher
2003/0060267 A1 3/2003 Glavich et al.
2003/0064773 A1 4/2003 Baerlocher et al.
2003/0203752 A1 * 10/2003 Kaminkow et al. ..... 463/20
2003/0203753 A1 * 10/2003 Muir et al. ..... 463/20
2003/0216165 A1 * 11/2003 Singer et al. ..... 463/20
2003/0232643 A1 12/2003 Inoue
2004/0012145 A1 1/2004 Inoue
2004/0014516 A1 1/2004 Inoue
2004/0014517 A1 1/2004 Inoue
2004/0018866 A1 1/2004 Inoue
2004/0026854 A1 2/2004 Inoue
2004/0036218 A1 2/2004 Inoue
2004/0038726 A1 2/2004 Inoue
2004/0041340 A1 3/2004 Inoue
2005/0054421 A1 3/2005 Hughs-Baird et al.
2006/0063578 A1 * 3/2006 Bansemer et al. ..... 463/13

FOREIGN PATENT DOCUMENTS

AU 199717601 B2 9/1997
AU A-50327/96 10/1997
AU 199747657 B2 6/1998
AU A-63553/98 10/1998
AU 199917318 A1 9/1999
DE 37008861 A1 8/2004
EP 0 798 676 B1 10/1997
EP 0 926 645 A2 6/1999
EP 0 944 030 A2 9/1999
EP 0 945 837 A2 3/2000
EP 0 984 408 A2 3/2000
EP 1296296 A2 * 3/2003
EP 1298609 A2 * 4/2003

| | | | |
|---|---|---|---|
| GB | 2 083 936 | A | 3/1982 |
| GB | 2 096 376 | A | 10/1982 |
| GB | 2 097 160 | A | 10/1982 |
| GB | 2 117 155 | A | 10/1983 |
| GB | 2 170 636 | A | 8/1986 |
| GB | 2 183 882 | A | 6/1987 |
| GB | 2 226 436 | A | 6/1990 |
| GB | 2 328 311 | A | 2/1999 |
| GB | 2 353 128 | A | 2/2001 |
| WO | WO 00/66235 | | 11/2000 |
| WO | WO 00/76606 | | 12/2000 |

OTHER PUBLICATIONS

David Christensen, "Slot Machines A Pictorial Review", 1972, The Vestal Press, pp. 98-99.*
3-Way Action Poker Brochure and Article written by written by IGT, published in 2002, on or before December thereof.
Barn Yard Advertisement written by Aristocrat, not dated.
Barn Yard Article written by Strictly Slots, published in Mar. 2002.
Introducing the "Smiling Ape" Machine Advertisement (including Joker's Wild Poker description) written by IGT, published prior to 2001.
Neon Nights written by IGT, published in 2000, on or before December thereof.
Polly & Roger Brochure written by VLC, Inc., published in 2000, on or before December thereof.
Take Your Pick Advertisement written by IGT/Anchor Gaming, published in 1999, on or before December thereof.
Take Your Pick Article, Strictly Slots, published Mar. 2001.
The Basics of Winning Video Poker (Chapter VI Deuces Wild & Chapter VII Jokers Wild) written by J. Edward Allen, published in 1990.
X Factor Brochure written by WMS Gaming, Inc., published in 1998, on or before December thereof.
X Factor Website Pages written by WMS, Gaming, Inc., printed on Jan. 15, 2001.
Black Swan Paytable Display written by IGT, published prior to 2001.
Boot Scootin Article written by Strictly Slots/Aristocrat Leisure Industries, PTY Ltd., published date unknown.
Break the Spell Atronic Web Page, published in Jan. 2001.
Break the Spell Brochure, published in 1999.
Cossack Dance Advertisement written by Olympic Video Gaming, published prior to 2002.
Enchanted Forest™ Gaming Description from Aristocrat, available in 1994.
Enchanted Unicorn Advertisement written by IGT, published in 2001.
Fishin' Buddies Article published in Strictly Slots/Anchor Games, published in Apr. 2001.
Jackpot Party Brochure and Articles written by WMS Gaming, Inc, published in 1988.
Joker's Wild Advertisement written by IGT, published prior to 2001.
Little Green Men, Jr. Advertisement written by A.C. Coin and Slot Services Company, published prior to 2002.
Mountain Money Article written by Strictly Slots/Aristocrat Leisure Industries, PTY Ltd., published in Jun. 2002.
Penguin Pays Advertisement written by Aristocrat Incorporated, published in 1998.
Reel Magic™ Gaming Machine Description written by IGT, available in 1986.
Your Real Key to Gaming Success Advertisement (including Roll Over Beethoven and Wild Fortune) written by Olympic Video Gaming, published dated unknown.

* cited by examiner

Press Here to see Keno/Bonus Symbol Matches

FIG. 5

74

Base Game Pays

Slot- Paytable of paying symbols and paying symbol combinations

Poker- Paytable of winning hands

Blackjack- Pay for beating dealer or bust by dealer

Keno- Pay for certain number of matches versus amount of numbers selected by player

FIG. 7

Secondary Symbols (weighting)

76

| | | | |
|---|---|---|---|
| A x 2 | (.03) | C x 3 | (.06) |
| A x 3 | (.06) | C x 5 | (.07) |
| A x 4 | (.07) | C x 7 | (.06) |
| A + 50 | (.06) | C x 9 | (.03) |
| A + 100 | (.03) | C + 5 | (.03) |
| B x 5 | (.06) | D x 4 | (.08) |
| B x 7 | (.05) | D x 8 | (.02) |
| B + 10 | (.08) | D + Spins | (.05) |
| B + 150 | (.05) | D + Scatter | (.05) |
| B + 1000 | (.01) | D + Voucher | (.05) |

70 70 70 78 78 76 70 76

FIG. 8

Bonus Pays

1. Multiplies triggering line win
2. Multiplies largest line win
3. Multiplies sum of line wins
4. In addition to triggering line win
5. In addition to largest line win
6. In addition to sum of line wins
7. Pay out separate from base game win

GAMING DEVICE HAVING A GAME WITH PRIMARY SYMBOLS, SECONDARY SYMBOLS ASSOCIATED WITH THE PRIMARY SYMBOLS AND INDEPENDENTLY GENERATED SECONDARY SYMBOLS

CROSS REFERENCE TO RELATED APPLICATIONS

This application relates to the following, commonly owned applications: "GAMING DEVICE HAVING A MULTI-CHARACTERISTIC MATCHING GAME," Ser. No. 09/813,698, now U.S. Pat. No. 6,749,502; "GAMING DEVICE HAVING TRANSFORMABLE WILD SYMBOLS OR CARDS WITH WILD SIGNAL INDICATORS," Ser. No. 09/957,305, now U.S. Pat. No. 6,780,502; "GAMING DEVICE HAVING WILD INDICATORS," Ser. No. 09/960,883, now U.S. Pat. No. 6,866,583; "GAMING DEVICE WITH WILD ACTIVATION SYMBOLS AND WILD TERMINATION SYMBOLS," Ser. No. 09/964,102, now U.S. Pat. No. 6,805,349; "GAMING DEVICE HAVING A VARIED WILD SYMBOL IN A BONUS GAME," Ser. No. 10/243,512, now abandoned; "GAMING DEVICE HAVING MULTI-CHARACTERISTIC SYMBOL GAME WITH MULTIPLE AWARD COMPONENTS," Ser. No. 09/967,546, now abandoned; "GAMING DEVICE HAVING SYMBOLS WITH TRANSFORMATION PROBABILITIES," Ser. No. 10/255,880, now U.S. Pat. No. 6,921,355; "GAMING DEVICE HAVING RESULTANT WILD SYMBOLS," Ser. No. 10/191,154, now U.S. Pat. No. 6,905,406; "GAMING DEVICE HAVING EXTENDER SYMBOLS," Ser. No. 10/191,197, now U.S. Pat. No. 7,169,042; "GAMING DEVICE HAVING A MULTI-ROUND, MULTI-CHARACTERISTIC CARD GAME," Ser. No. 10/661,219, now U.S. Pat. No. 7,128,646; "GAMING DEVICE HAVING A MULTI-ROUND MULTI-CHARACTERISTIC MATCHING GAME," Ser. No. 10/243,706, now U.S. Pat. No. 7,040,983; "GAMING DEVICE HAVING A MULTI-CHARACTERISTIC MATCHING GAME INCLUDING SELECTION INDICATORS," Ser. No. 10/243,192, now U.S. Pat. No. 7,056,209; "GAMING DEVICE SYMBOL DISPLAY HAVING A DISPLAY WINDOW," Ser. No. 29/189,903, now U.S. Pat. No. D496,968; "GAMING DEVICE HAVING SYMBOL REVEALING MECHANISM," Ser. No. 10/935,019; "GAMING DEVICE HAVING AN AWARD PLATE AND AN INDICATOR PLATE FOR DISPLAYING SELECTED AWARDS," Ser. No. 10/941,479; "GAMING DEVICE HAVING CONCENTRIC REELS INCLUDING A NUDGE SYMBOL," Ser. No. 10/934,162; "GAMING DEVICE HAVING CONCENTRIC REELS INCLUDING AN OUTER REEL WITH DISPLAY AREAS HAVING DIFFERENT SIZES AND POSITIONS," Ser. No. 10/945,517; "GAMING DEVICE HAVING A MULTI-CHARACTERISTIC MATCHING GAME," Ser. No. 10/864,794, now U.S. Pat. No. 7,059,967; "GAMING DEVICE HAVING A ROTATABLE MECHANICAL AWARD INDICATOR PARTIALLY COVERED BY A MASK," Ser. No. 10/896,437, now U.S. Pat. No. 7,217,189; "GAMING DEVICE SYMBOL DISPLAY HAVING MULTIPLE DISPLAY WINDOWS," Ser. No. 29/212,196, now U.S. Pat. No. D504,473; "GAMING DEVICE HAVING TRANSFORMABLE WILD SYMBOLS OR CARDS WITH WILD SIGNAL INDICATORS," Ser. No. 10/920,798; "GAMING DEVICE HAVING WILD INDICATORS," Ser. No. 11/015,842, now U.S. Pat. No. 7,137,888; "GAMING DEVICE HAVING WILD INDICATORS," Ser. No. 10/982,096, and "GAMING DEVICE WITH WILD ACTIVATION SYMBOLS AND WILD TERMINATION SYMBOLS," Ser. No. 10/966,223; "GAMING DEVICE WITH WILD ACTIVATION SYMBOLS AND WILD TERMINATION SYMBOLS," Ser. No. 11/211,238; "GAMING DEVICE HAVING GAME WITH SYMBOLS AND ADJACENTLY DISPLAYED COMPLIMENTARY SUB-SYMBOLS," Ser. No. 11/558,304; and "GAMING DEVICE AND METHOD HAVING MULTIPLE PROGRESSIVE AWARD LEVELS AND A SECONDARY GAME FOR ADVANCING THROUGH THE PROGRESSIVE AWARD LEVELS," Ser. No. 11/462,285.

BACKGROUND OF THE INVENTION

Gaming device manufactures have long provided gaming machines employing a plurality of reels, wherein the reels each have a plurality of symbols. In the 1930's, gaming device manufacturers provided a three reel gaming device, wherein each reel had ten stops, which produced a thousand combinations. One way for the manufacturers to increase the number of combinations was to increase the size of the reel and to add more stops. During the next four decades, the reels in the gaming devices increased to twenty stops. In the 1970's, manufacturers developed a twenty-two stop reel machine, in the early 80's a twenty-five stop reel machine, and in 1985, a thirty-two stop reel machine. This last machine had 32,768 possible combinations.

Another way manufacturers increased the number of combinations was to add reels. In 1955, a manufacturer produced a four-reel slot machine, which increased the number of possible symbol combinations. In the middle 1970's, a manufacturer produced the first five-reel slot machine, which had twenty-two stop reels and produced combinations in excess of five million.

The next advancement in the effort to produce more payout combinations was the video or CRT screen slot machine, wherein the reels were simulated as opposed to mechanical. Video slot machines do not have mechanical drums or reels which rotate, do not need to precisely stop the same at certain positions and are therefore not limited by a maximum allowable drum radius. Each reel can have an unlimited number of stops. Initially, the Nevada gaming Commission limited the stops on the video machines (e.g., eighty-four stops on a three reel machine) but has since removed the limit. In 1989, a particular video reel machine employed reels having hundreds of stops and millions combinations.

The total number of combinations affects the percentage of time that a player will obtain a particular winning combination as well as the overall payout percentage of the machine. For example, a three reel machine having twenty-two stops per reel, where the first reel has two oranges, the second reel has three oranges, and the third reel has seven oranges will yield an orange, orange and orange combination 42 times in every 10,648 plays (22×22×22) or 0.39% of the time. If the orange, orange, orange combination pays 20 coins, then the total coins paid is 20×42 or 840 coins in every 10,648 plays. Adding the total coins paid for each winning combination and dividing that number by 10,648 yields the machine's total payout percentage.

In the known gaming systems the percentage of obtaining a winning combination is set. In certain known progressive gaming machines, the payout of a grand prize grows each time a player plays the machine. The increasing payout increases the total coins paid as shown above, which in turn increases the overall payout percentage. Nevertheless, the average percentage of times that a player will receive one of the combinations remains constant.

To increase player enjoyment and excitement, it is desirable to provide players with new types of gaming devices that attract the player and keep the player entertained. Gaming devices having secondary reels are known as disclosed for example in U.S. Pat. Nos. 5,722,891 and 6,533,273. Secondary reels provide an avenue for adding fun and excitement to standard gaming, while maintaining consistency with the primary slot game and enabling the primary slot game to be played and displayed on a separate, simulated or electromechanical, display. Accordingly, a need exists for the further development of secondary games and displays that operate with or are integrated or semi-integrated with the base or standard wagering game.

SUMMARY OF THE INVENTION

One embodiment of the present invention provides a gaming device having a primary game operable upon a wager such as a slot game, a poker game, a blackjack game or a keno game. The present invention may also or alternatively be employed as a secondary game triggered in a primary game or another secondary game. The primary game produces base game wins upon winning symbols or paying symbol combinations. Symbols in the base game are associated with sub-symbols or secondary symbols. For example, the secondary symbols may be displayed adjacent to or behind the base game symbols.

In one primary embodiment, the gaming device provides an additional symbol display area or activator that generates one or more of the secondary symbols in addition to the generation of the secondary symbols associated with the primary game symbols. The gaming device provides a game with primary symbols, secondary symbols associated with the primary symbols, and independently generated secondary symbols that can result in additional awards.

In one embodiment, if the player obtains a winning symbol or winning symbol combination and one of the winning symbols is associated with a secondary symbol that matches the secondary symbol generated in the additional display, the player is provided an additional award or a bonus award. For example, the secondary symbol generated in the additional display can include an associated bonus award (such as a value or multiplier). The player is provided the bonus award associated with the secondary symbol generated on the separate display if that secondary symbol matches a secondary symbol associated with the paying symbol or one of the symbols of the paying symbol combination. The bonus awards can be of any suitable type, such as credit multipliers, credit values, free spins, free games, scatter pays and non-monetary awards.

In one implementation, the bonus award is provided only if a secondary symbol match occurs in association with one of the winning symbols or symbols of the winning symbol combination. Alternatively, the bonus award is paid if the match occurs along a payline or in a hand of poker, even though the associated game symbol is not part of the paying or winning combination. Further alternatively, the bonus award can be provided even if the match occurs along a different payline or different hand of poker than the payline or hand in which the secondary symbol match occurs. Still further, the bonus award can be paid even if no base game win occurs. These and many other alternative embodiments are described in detail below.

It should be appreciated that the bonus award provided to the player does not have to be displayed in connection with the generated secondary symbol but can alternatively be generated elsewhere on or in association with the gaming device. Further, multiple bonuses can be paid for matches occurring along multiple slot paylines or multiple poker hands. Furthermore, two or more symbols of a single payline or hand may produce a match with the secondary symbol generated separate and apart from the base game symbol generation. Here, the additional or bonus award can be provided for each occurrence. In particular, two or more multipliers can be added together to form an overall multiplier that is applied to the player's base game win. The base game win itself has many different alternatives. The base game win can simply be the win along the associated payline. Alternatively, the base game win is the sum of wins occurring along multiple paylines or hands of poker.

In another primary embodiment, a separate secondary symbol display is not provided, however, secondary symbols are displayed in association with the base game symbols as before. The secondary symbols associated with the game symbols instead are evaluated to determine if a winning secondary symbol or symbol combination has occurred. If so, a base game payout is modified in one embodiment. In one embodiment, the winning secondary symbol or symbol combination must occur in association with a winning base game symbol or winning combination of base game symbols, for example, along an active payline of a slot machine. Various embodiments governing when a winning secondary symbol or symbol combination is activated or effective are discussed herein. Also, various embodiments for the types of award modifications (including stand alone awards) are discussed herein.

In a further primary embodiment, (i) a separate secondary symbol display or activator is provided, and (ii) one or more secondary symbol(s) associated with the base game symbol (s) is evaluated with a secondary symbol generated on the secondary display to determine if a winning secondary symbol or symbol combination has occurred. If so, a base game payout is modified in one implementation. In one implementation, the winning secondary symbol or symbol combination must occur in association with a winning base game symbol or winning combination of base game symbols, for example, along an active payline of a slot machine. Various embodiments discussed herein govern when a winning secondary symbol or symbol combination is activated or effective. The present invention also contemplates the types of award modifications (including stand alone awards) provided in an alternative embodiment.

The secondary symbols may be permanently associated with the base game symbols, e.g., displayed on the same simulated or electromechanical reel strip. Alternatively, the secondary symbols are provided on concentric or adjacent electromechanical reels. Here, the secondary symbols are not fixed to the base symbols and are generated separately. Separate generations can also be achieved via simulated or virtual reels.

It is an advantage of the present invention to provide a bonus award that can occur frequently in a base game.

Additional features and advantages of the present invention are described in, and will be apparent from, the following Detailed Description of the Invention and the figures.

BRIEF DESCRIPTION OF THE FIGURES

FIG. 5 is a table listing base game pays, showing paying symbol combinations used in connection with the present invention.

FIG. 7 illustrates one possible set for the secondary symbols of the present invention, wherein the symbols are generated randomly according to a weighted system.

FIG. 8 is a non-exhaustive list of different embodiments for the bonus payout of the present invention.

DETAILED DESCRIPTION OF THE INVENTION

Figure 1A:
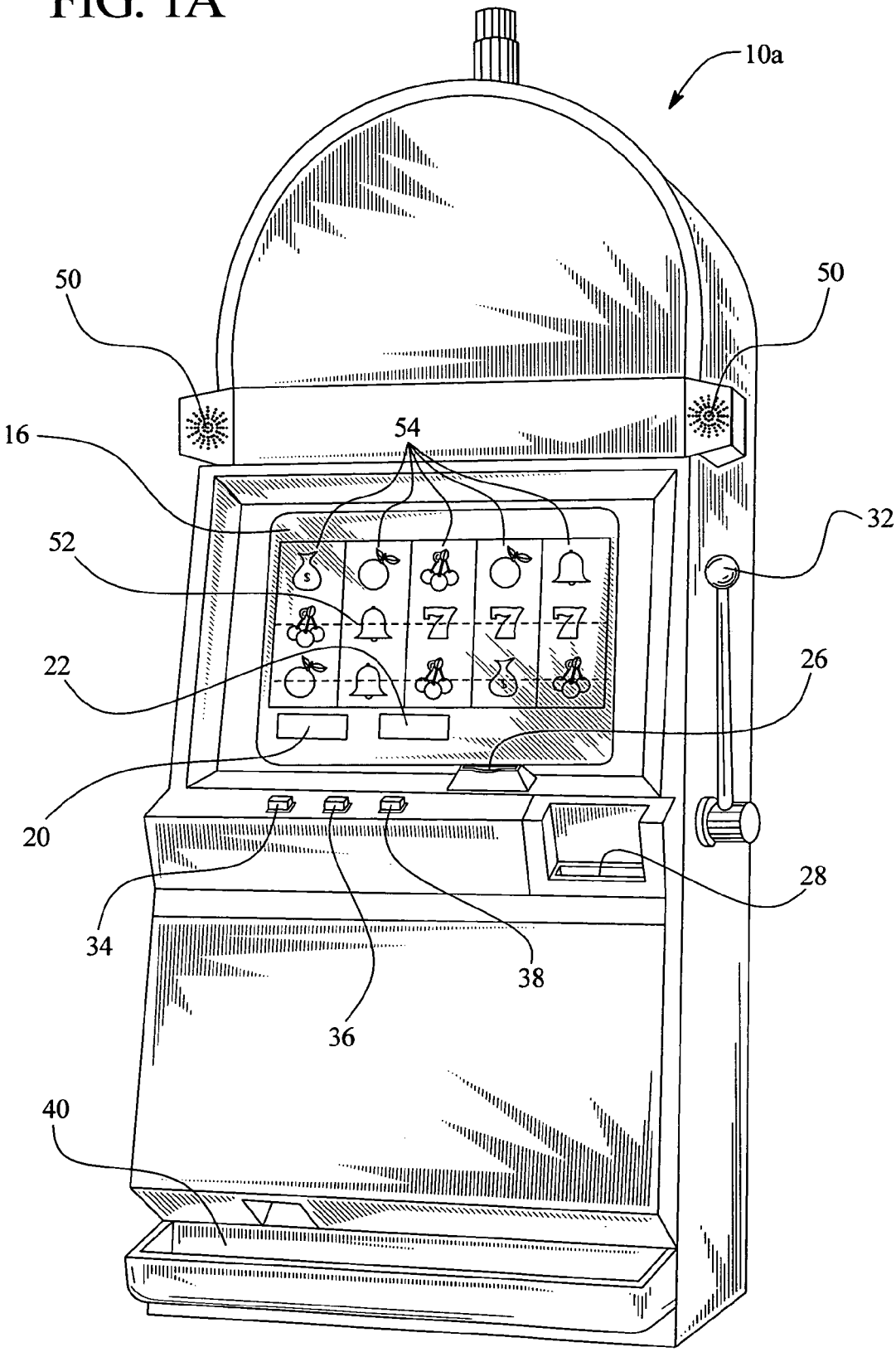
FIG. 1A is a front perspective view of one embodiment of the gaming device of the present invention.
Figure 1B:
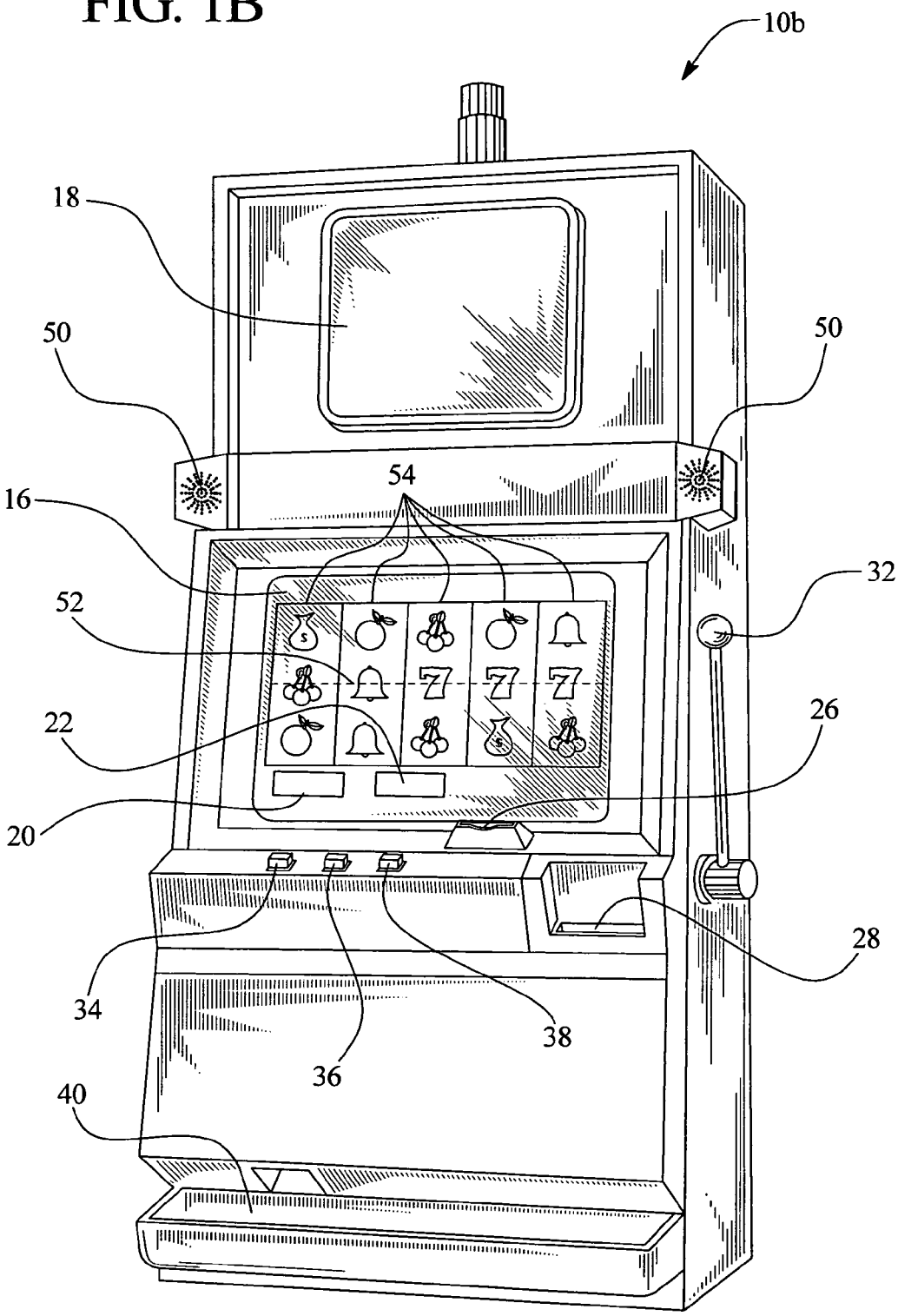
FIG. 1B is a front perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. Gaming device 10 may be positioned on a base or stand or can be configured as a pub-style table-top game (not shown) which a player can operate preferably while sitting. As illustrated by the different configurations shown in FIGS. 1A and 1B, gaming device 10 can be constructed with varying cabinet and display configurations.

Figure 2A:
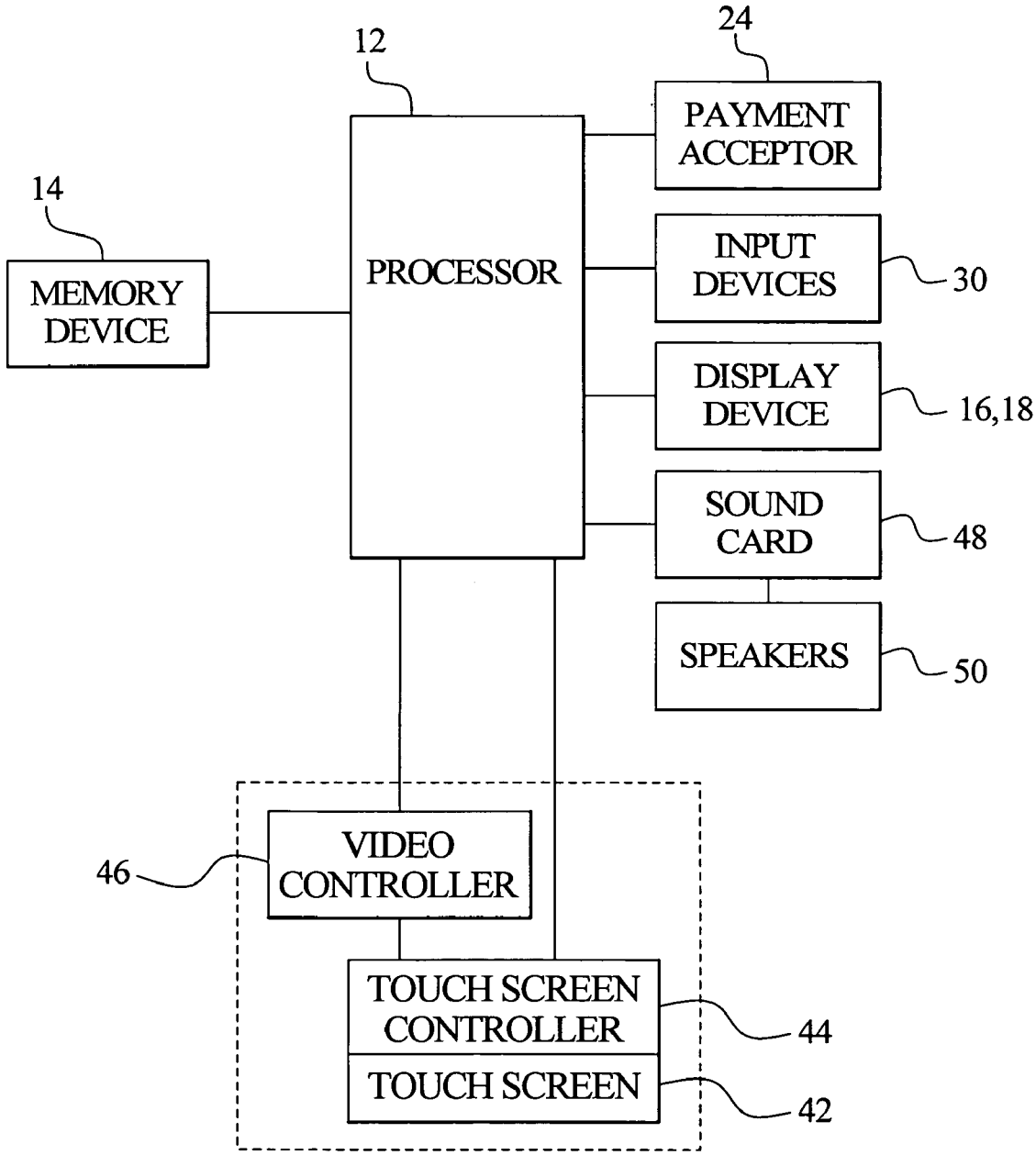
FIG. 2A is a schematic block diagram of one embodiment of an electronic configuration for one of the gaming devices of the present invention.

In one embodiment, as illustrated in FIG. 2A, gaming device 10 preferably includes at least one processor 12, such as a microprocessor, a microcontroller-based platform, a suitable integrated circuit or one or more application-specific integrated circuits (ASIC's). Processor 12 is in communication with or operable to access or to exchange signals with at least one data storage or memory device 14. In one embodiment, processor 12 and memory device 14 reside within the cabinet of gaming device 10. Memory device 14 stores program code and instructions, executable by processor 12, to control gaming device 10. Memory device 14 also stores other data such as image data, event data, player input data, random or pseudo-random number generators, pay-table data or other operating data, information and applicable game rules that relate to the play of gaming device 10. In another embodiment, memory device 14 includes random access memory (RAM). In one embodiment, memory device 14 includes read only memory (ROM). In a further embodiment, memory device 14 includes flash memory and/or EEPROM (electrically erasable programmable read only memory). Any other suitable magnetic, optical and/or semiconductor memory may be implemented in conjunction with gaming device 10 of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. Processor 12 and memory device may be collectively referred to herein as a "computer" or "controller."

In one embodiment, as discussed in more detail below, gaming device 10 randomly generates awards and/or other game outcomes based on probability data. That is, each award or other game outcome is associated with a probability and gaming device 10 generates the award or other game outcome to be provided to the player based on the associated probabilities. In this embodiment, since gaming device 10 generates outcomes randomly or based upon a probability calculation, there is no certainty that gaming device 10 will provide the player with any specific award or other game outcome.

In another embodiment, as discussed in more detail below, gaming device 10 employs a predetermined or finite set or pool of awards or other game outcomes. In this embodiment, as each award or other game outcome is provided to the player, gaming device 10 removes the provided award or other game outcome from the predetermined set or pool. Once removed from the set or pool, the specific provided award or other game outcome cannot be provided to the player again. In this type of embodiment, gaming device 10 provides players with all of the available awards or other game outcomes over the course of the play cycle and guarantees a designated amount of actual wins and losses.

In one embodiment, as illustrated in FIG. 2A, gaming device 10 includes one or more display devices controlled by processor 12. The display devices are preferably connected to or mounted to the cabinet of gaming device 10. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, gaming device 10 includes a credit display 20 which displays a player's current number of credits, cash, account balance or the equivalent. In one embodiment, gaming device 10 includes a bet display 22 which displays a player's amount wagered.

The display devices may include, without limitation, a monitor, a television display, a plasma display, a liquid crystal display (LCD), a display based on light emitting diodes (LED) or any other suitable electronic device or display mechanism. In one embodiment, as described in more detail below, the display device includes a touchscreen 42 with an associated touchscreen controller 44. The display devices may be of any suitable configuration, such as a square, a rectangle or an elongated rectangle.

The display devices of gaming device 10 are configured to display at least one and preferably a plurality of games or other suitable images, symbols and indicia such as any visual representation or exhibition of the movement of objects such as mechanical, virtual or video reels and wheels, dynamic lighting, video images and images of people, characters, places, things and faces of cards, tournament advertisements, promotions and the like.

In one alternative embodiment, the symbols, images and indicia displayed on or by the display device may be in mechanical form. That is, the display device may include any suitable electromechanical device which preferably moves one or more mechanical objects, such as one or more mechanical rotatable wheels, reels or dice, configured to display at least one and preferably a plurality of games or other suitable images, symbols or indicia.

As illustrated in FIG. 2A, in one embodiment, gaming device 10 includes at least one payment acceptor 24 in communication with processor 12. As seen in FIGS. 1A and 1B, the payment acceptor may include a coin slot 26 and a payment, note, bill or card (credit, debit, casino, player tracking or smart) acceptor 28, where the player inserts money, coins or tokens. The player can place coins in the coin slot or paper money, ticket or voucher into the payment, note or bill acceptor. In other embodiments, devices such as readers or validators for credit cards, debit cards, data cards or credit slips could be used for accepting payment.

In one embodiment, a player may insert an identification card into a card reader 28 of gaming device 10. Card reader 28 is operable with a dedicated keypad or a keypad (not illustrated) appearing on display device 16, 18, which cooperates with touch screen 42 and touch screen controller 44 to enable the player to enter passwords, process fund requests, cancel fund requests and the like.

The identification card can be a smart card having a programmed microchip or a magnetic strip coded with a player's identification, credit totals and other relevant information. In one embodiment, money may be transferred to a gaming device through electronic funds transfer. When a player funds gaming device 10, processor 12 determines the amount of funds entered and the corresponding amount is shown on the credit or other suitable display as described above. Card reader 60 alternatively or additionally accepts payment cards, such as credit cards or debit cards. Card reader 60 in one embodiment includes a magnetic strip reader as is known to those of skill in the art.

As seen in FIGS. 1A, 1B and 2A, in one embodiment gaming device 10 includes at least one and preferably a plurality of input devices 30 in communication with processor 12. The input devices can include any suitable device which enables the player to produce an input signal which is read by processor 12. In one embodiment, after appropriate funding of gaming device 10, the input device is a game activation device, such as a pull arm 32 or a play button 34 which is used by the player to start any primary game or sequence of events in gaming device 10. The play button can be any suitable play activator such as a bet one button, a max bet button or a repeat the bet button. In one embodiment, upon appropriate funding, gaming device 10 begins the game play automatically. In another embodiment, upon the player engaging one of the play buttons, gaming device 10 automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game associated with gaming device 10.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips which are redeemable by a cashier or funded to the player's electronically recordable identification card.

In one embodiment, as mentioned above and seen in FIG. 2A, one input device is a touchscreen 42 coupled with a touchscreen controller 44, or some other touch-sensitive display overlay to allow for player interaction with the images on the display. The touchscreen and the touchscreen controller are connected to a video controller 46. A player can make decisions and input signals into gaming device 10 by touching the touchscreen at the appropriate places.

Gaming device 10 may further include a plurality of communication ports for enabling communication of processor 12 with external peripherals, such as external video sources, expansion buses, game or other displays, an SCSI port or a key pad.

In one embodiment, as seen in FIG. 2A, gaming device 10 includes a sound generating device controlled by one or more sounds cards 48 which function in conjunction with processor 12. In one embodiment, the sound generating device includes at least one and preferably a plurality of speakers 50 or other sound generating hardware and/or software for generating sounds, such as playing music for the primary and/or secondary game or for other modes of gaming device 10, such as an attract mode. In one embodiment, gaming device 10 provides dynamic sounds coupled with attractive multimedia images displayed on one or more of the display devices to provide an audio-visual representation or to otherwise display full-motion video with sound to attract players to gaming device 10. During idle periods, gaming device 10 may display a sequence of audio and/or visual attraction messages to attract potential players to gaming device 10. The videos may also be customized for or to provide any appropriate information.

In one embodiment, the gaming machine may include a player or other sensor, such as a camera in communication with processor 12 (and possibly controlled by processor 12) that is selectively positioned to acquire an image of a player actively using gaming device 10 and/or the surrounding area of gaming device 10. In one embodiment, the camera may be configured to selectively acquire still or moving (e.g., video) images and may be configured to acquire the images in either an analog, digital or other suitable format. The display device may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Gaming device 10 can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation of the game from a wager made by the player. That is, different primary wagering games, such as video poker games, video blackjack games, video keno, video bingo or any other suitable primary or base game may be implemented into the present invention.

Slot

In one embodiment, as illustrated in FIGS. 1A and 1B, a base or primary game may be a slot game with one or more paylines 52. The paylines may be horizontal, vertical, circular, diagonal, angled or any combination thereof. In this embodiment, gaming device 10 displays at least one reel and preferably a plurality of reels 54, such as three to five reels, in either electromechanical form with mechanical rotating reels or in video form with simulated reels and movement thereof. In one embodiment, an electromechanical slot machine includes a plurality of adjacent, rotatable wheels which may be combined and operably coupled with an electronic display of any suitable type. In another embodiment, if the reels are in video form, the plurality of simulated video reels are displayed on one or more of the display devices as described above. Each reel displays a plurality of indicia such as bells, hearts, fruits, numbers, letters, bars or other images which preferably correspond to a theme associated with gaming device 10. In this embodiment, gaming device 10 awards prizes when the reels of the primary game stop spinning if specified types and/or configurations of indicia or symbols occur on an active pay line or otherwise occur in a winning combination or pattern.

Poker

In one embodiment, a base or primary game may be a poker game wherein gaming device 10 enables the player to play a conventional game of video poker and initially deals five cards, all face up, from a virtual deck of fifty-two cards. Cards may be dealt as in a traditional game of cards or in the case of gaming device 10, the cards may be randomly selected from a predetermined number of cards. If the player wishes to draw, the player selects the cards to hold by using one or more input devices, such as pressing related hold buttons or touching a corresponding area on a touchscreen. After the player presses the deal button, processor 12 of gaming device 10 removes the unwanted or discarded cards from the display and deals replacement cards from the remaining cards in the deck. This results in a final five-card hand. Processor 12 of gaming device 10 compares the final five-card hand to a payout table which utilizes conventional poker hand rankings to determine the winning hands. An award based on a winning hand and the credits wagered is provided to the player.

Multi-Hand Poker

In another embodiment, the base or primary game may be a multi-hand version of video poker. In this embodiment, the player is dealt at least two hands of cards. In one such embodiment, the cards in all of the dealt hands are the same cards. In one embodiment each hand of cards is associated with its own deck of cards. The player chooses the cards to hold in a primary hand. The held cards in the primary hand are also held in the other hands of cards. The remaining non-held cards are removed from each displayed hand and replaced with randomly dealt cards. Since the replacement cards are randomly dealt independently for each hand, the replacement cards will usually be different for each hand. The poker hand rankings are then determined hand by hand and awards are provided to the player.

Keno

In one embodiment, a base or primary game may be a keno game wherein gaming device 10 displays a plurality of selectable indicia or numbers on at least one of the display devices. In this embodiment, the player selects at least one and preferably a plurality of the selectable indicia or numbers by using an input device or by using the touchscreen. Gaming device 10 then displays a series of drawn numbers to determine an amount of matches, if any, between the player's selected numbers and the gaming device's drawn numbers. The player is provided an award, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a bonus prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, gaming device 10 includes a program code which causes processor 12 to automatically begin a bonus round when the player has achieved a triggering event, a qualifying condition or other designated game event in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be triggered by exceeding a certain amount of game play (number of games, number of credits, amount of time), earning a specified number of points during game play or as a random award.

In one embodiment, once a player has qualified for a bonus game, the player may subsequently enhance their bonus game participation by returning to the base or primary game for continued play. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game. The player must win or earn entry through play of the primary game, thereby encouraging play of the primary game. In another embodiment, qualification of the bonus or secondary game could be accomplished through a simple "buy in" by the player if, for example, the player has been unsuccessful at qualifying for the bonus game through other specified activities.

Figure 2B:
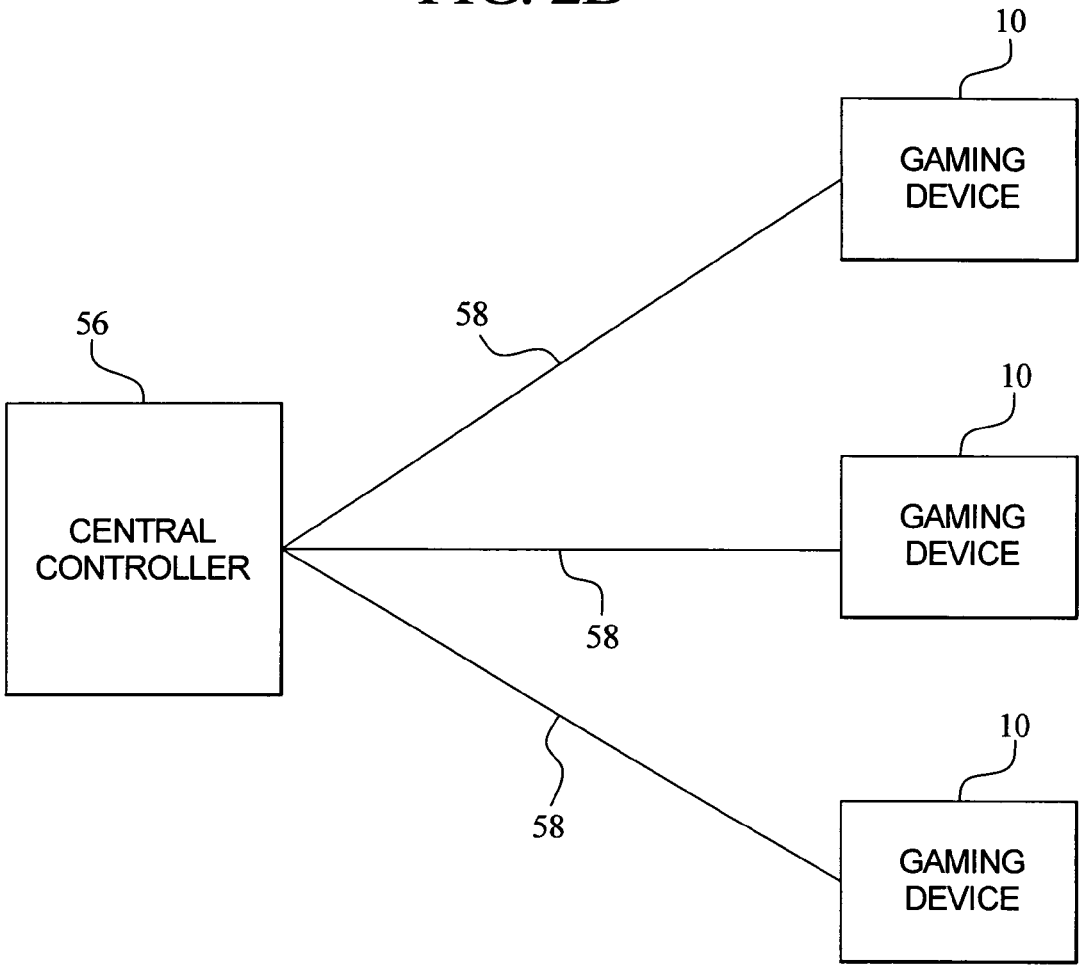
FIG. 2B is a schematic block diagram of one embodiment of a network configuration for a plurality of gaming devices of the present invention.

In one embodiment, as illustrated in FIG. 2B, one or more of the gaming devices 10 of the present invention may be connected to a data network or a remote communication link 58 with some or all of the functions of each gaming device provided at a central location such as a central server or central controller 56. More specifically, processor 12 of each gaming device may be designed to facilitate transmission of signals between the individual gaming device and the central server or controller.

In one embodiment, the game outcome provided to the player is determined by central server or controller 56 and provided to the player at gaming device 10 of the present invention. In this embodiment, each of a plurality of such gaming devices are in communication with the central server or controller 56. Upon a player initiating game play at one of the gaming devices, the initiated gaming device communicates a game outcome request to the central server or controller 56.

In one embodiment, central server or controller 56 receives the game outcome request and randomly generates a game outcome for the primary game based on probability data. In another embodiment, central server or controller 56 randomly generates a game outcome for the secondary game based on probability data. In another embodiment, central server or controller 56 randomly generates a game outcome for both the primary game and the secondary game based on probability data. In this embodiment, central server or controller 56 is capable of storing and utilizing program code or other data similar to processor 12 and memory device of gaming device 10.

In an alternative embodiment, central server or controller 56 maintains one or more predetermined pools or sets of predetermined game outcomes. In this embodiment, central server or controller 56 receives the game outcome request and independently selects a predetermined game outcome from a set or pool of game outcomes. Central server or controller 56 flags or marks the selected game outcome as used. Once a game outcome is flagged as used, it is prevented from further selection from the set or pool and cannot be selected by central controller 56 or server upon another wager. The provided game outcome can include a primary game outcome, a secondary game outcome, primary and secondary game outcomes, or a series of game outcomes such as free games.

Central server or controller 56 communicates the generated or selected game outcome to the initiated gaming device. Gaming device 10 receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by central server or controller 56 and communicated to the initiated gaming device to be presented or displayed to the player. Central production or control can assist a gaming establishment or other entity in maintaining appropriate records, controlling gaming, reducing and/or preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or an on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected to a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of gaming device 10 can be viewed at gaming device 10 with at least one internet browser. In this embodiment, operation of gaming device 10 and accumulation of credits may be accomplished with only a connection to the central server or controller (the internet/intranet server or webserver) through a conventional phone or other data transmission line, digital signal line (DSL), T-1 line, coaxial cable, fiber optic cable, wireless gateway or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between gaming device 10 hardware and software and the host site computer.

Figures 3A, 3B, 3C, 4A, 4B, 4C:
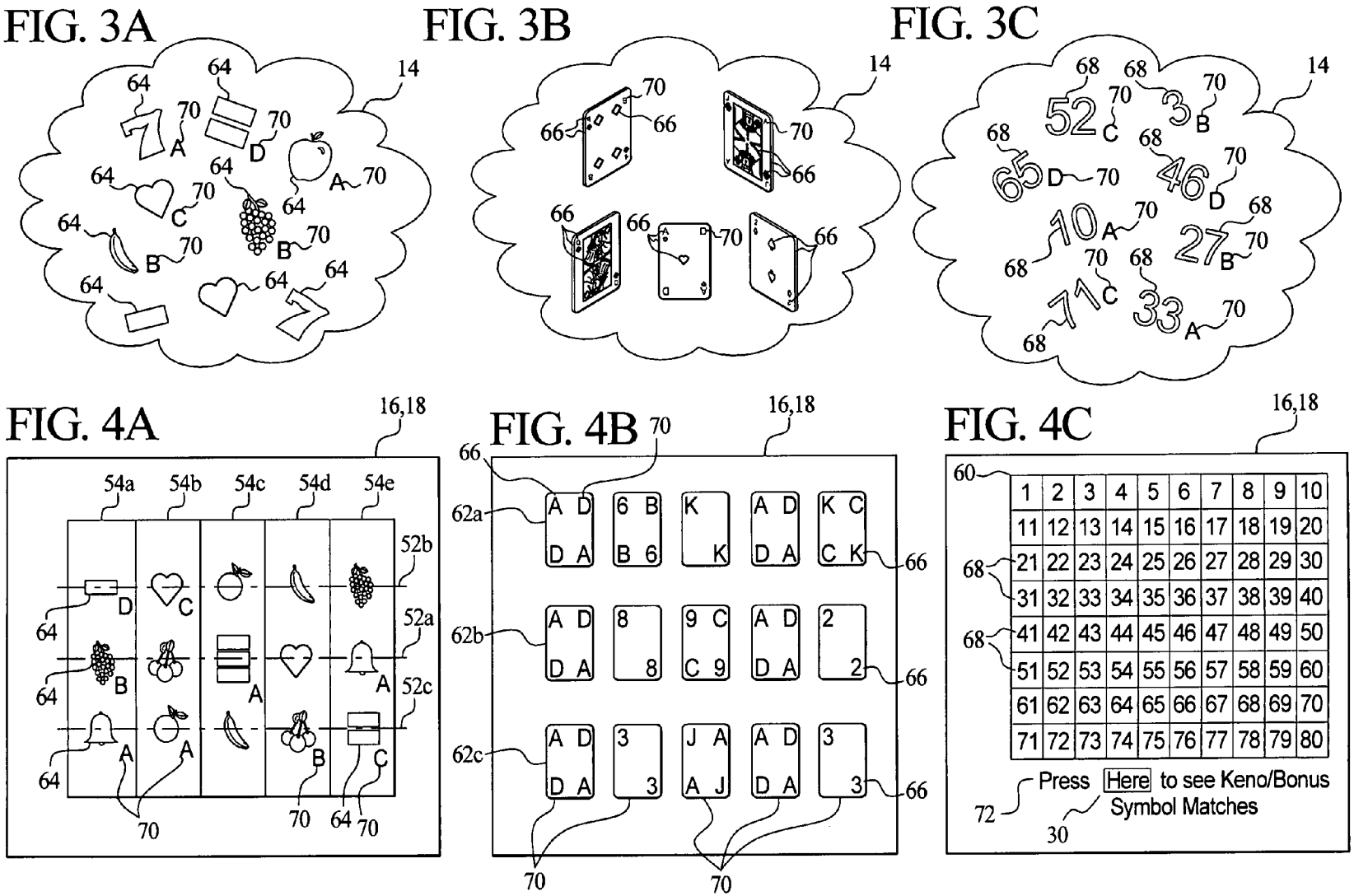
FIGS. 3A, 3B and 3C diagrammatically show areas of memory containing the base or main game symbols in association with the secondary symbols of the present invention.
FIGS. 4A, 4B and 4C are elevation views of one of the display devices of the gaming device showing various embodiments for the symbol display areas of the present invention.

Referring now to FIGS. 3A to 3C, the wagering games of the present invention include base game symbols. Each of FIGS. 3A to 3C diagrammatically illustrate symbols stored in an area of memory device 14. FIG. 3A illustrates a plurality of different slot machine symbols 64, such as lucky 7s, hearts, half-moons, bars and fruit. FIG. 3B illustrates a plurality of poker or blackjack symbols 66. Symbols 66 include the symbols of a conventional playing card including an associated number or other denomination, such as jacks, queens, kings and aces, as well as a suit, i.e., diamonds, hearts, clubs and spades. Each of those indicia and the card itself is part of game symbol 66. Symbols 66 alternatively are used in any type of game employing playing cards.

FIG. 3C illustrates a plurality of keno symbols or numbers 68. While numbers are used in one embodiment of keno, it is possible to use other types of symbols in the symbol matching game of keno. Symbols 64, 66 and 68 each represent base game symbols that are used to play a base wagering game.

Certain ones of each of the base game symbols 64, 66 and 68 are associated with sub-symbols or secondary symbols 70. Secondary symbols 70 may have any suitable type of indicia and are shown here for convenience as the letters A, B, C and D. The present invention is not intended to limit the number of different secondary symbols. That is, the present invention can have less than four different secondary symbols 70 or more than four different secondary symbols. Furthermore, the slot machine symbols 64 can be any suitable symbols and are not limited to the symbols used herein. The base games of slot, poker and keno adequately illustrate the features and advantages of the present invention. It should be appreciated, however, that the present invention is not limited to such base games and can instead include any base wagering game having symbols capable of being associated with secondary symbols 70 and having certain symbols or symbol combinations that are winning or paying symbols and combinations.

Referring now to FIGS. 4A, 4B and 4C, display areas for each of the base games illustrated in connection with FIGS. 3A, 3B and 3C are shown. FIG. 4A illustrates that the slot game includes display areas 54*a* to 54*e*, referred to and described above collectively as slot machine reels. In conventional slot game, the player spins the reels and a certain portion such as three symbols of a reel strip (excluding blanks or blank symbols) are shown on each reel 54*a* to 54*e*. In the illustrated embodiment, the reels 54 are shown on a video monitor 16 or 18 and are therefore simulated. Alternatively, reels 54*a* to 54*e* can be electromechanical. The reels generate and display base game or slot symbols 64 in display areas 54 appearing on one or more paylines 52*a* to 52*c*. Secondary symbols 70 are also displayed as discussed below.

The slot embodiment of the present invention can include any suitable number of reels, each having any suitable number of paystops. In one embodiment, three base game reels are used (five reels are shown in FIG. 4A and FIGS. 9 to 13 to help describe various alternative embodiments). As discussed below, certain slot embodiments include one or more additional secondary symbol reels or displays. The secondary symbol reels display outcomes of random generations performed independently of the random generations for the base game reels.

As illustrated in FIGS. 3A and 4A, not all slot machine symbols 64 are associated with secondary symbols 70 in one embodiment. In an alternative embodiment, each of the slot machine symbols 64 is associated with a secondary symbol 70. Still further alternatively or additionally, one or more of the slot machines is associated with two or more secondary symbols 70. Each of the alternatives discussed herein is applicable to the slot machine symbols 64, poker or blackjack symbols 66, keno symbols 68 or other suitable primary game symbols.

FIG. 4B illustrates that the poker or blackjack game includes three display areas 62*a*, 62*b* and 62*c*. Those display areas each display a hand of poker or randomly generated set of symbols 66. For instance, the poker game may be a multiplay poker game in which one or more cards, such as an ace, dealt in one hand 62 is used in one or both of the additional hands 62. As with slot machine symbols 64, poker or blackjack symbols 66 may or may not be associated with a secondary symbol 70. FIG. 4C illustrates a single display area 60 for the game of keno. In one embodiment, eighty keno numbers are displayed in display area 60. The player designates certain ones of those numbers one to eighty. Game device 10 then generates randomly another subset of the numbers from one to eighty. The number of matches dictates the player's award. Any one or more or all eighty numbers may each be associated with one or more secondary symbols 70.

FIGS. 4A and 4B illustrate an embodiment where the secondary symbols 70 are associated adjacent to or in the game symbols 64 and 66. The proximity of the secondary symbol 70 to the game symbol 64 or 66 illustrates the association to the player. FIG. 4C illustrates an alternative embodiment, wherein an audio, visual or audiovisual message 72 informs the player to press an input device 30 to recall a separate screen on one of the display devices 16 or 18 that shows the player each of the existing game and secondary symbol associations.

FIG. 5 illustrates a table 74 of different base game pays. As illustrated below, it is important in certain embodiments to identify which symbols displayed in the display areas shown above are paying or winning symbols. According to table 74 of FIG. 5, slot includes a paytable of paying symbols and paying symbol combinations that informs the player of the number of credits, one for each paying symbol or combination. Poker includes a paytable of winning hands or playing card combinations. Blackjack includes a pay for beating the dealer or enabling the dealer to bust. Keno includes a paytable that pays for a certain number of matches versus an amount of numbers selected by the player. In general, the more numbers selected by the player the more matches required to win an award.

Base and Secondary Reels

As discussed below, the game of the present invention includes the random generation of base game symbols and the random generation of secondary symbols, wherein the secondary symbols are placed in association with at least some of the base game symbols. The association can be performed in a variety of ways. In one embodiment, the secondary symbols are permanently associated with certain base game symbols. That is, every time a particular base game symbol appears, its associated secondary symbol is also generated. Here, the reels can be simulated on one of the display devices 16 or 18 or electromechanical reels.

In a second embodiment, the secondary symbols are simulated and generated on one of the display devices 16 or 18 randomly and independently with respect to the randomly generated and simulated base game symbols. Here, the simulated display can show (i) a rotation or visual morphing of the base reels in combination with a rotation of secondary reels, each located next to a base game reel, or (ii) a spinning of individual paystop positions for each of the secondary symbols. In either case, the video monitor provides a visual representation of a random outcome generation of secondary symbols separate from and similar to that seen when viewing the rotation of the base game reels.

In a third embodiment, the secondary symbols are displayed on electromechanical or physical reels and generated randomly and independently with respect to the base game symbols, which are also displayed on electromechanical or physical reels. Such electromechanical concentric reels are known in the art and are described for example in U.S. Pat. No. 5,395,111.

It should be appreciated that the secondary symbols can be any suitable type of visual identifiers, including different shapes, patterns or colors. The different secondary symbols may simply be different colors. In such a case, and when the reels are concentric electromechanical reels, the base game symbols in one embodiment are displayed on the outer reel and overlap the secondary symbols, which are provided on an inner reel. The different secondary symbols may alternatively include shapes or indicia. In such a case, and when the reels are concentric electromechanical reels, the secondary symbols are displayed on the inner reels but are displayed off to the side of (and/or above or below) the base game symbols, which are displayed on the outer reel. For example, FIGS. 3A, 9, 10, 11, 12 and 13 show base game symbols 64 and secondary symbols 70 located individually adjacent to the base game symbols 64 (e.g., in a subscript type arrangement).

Figure 6:
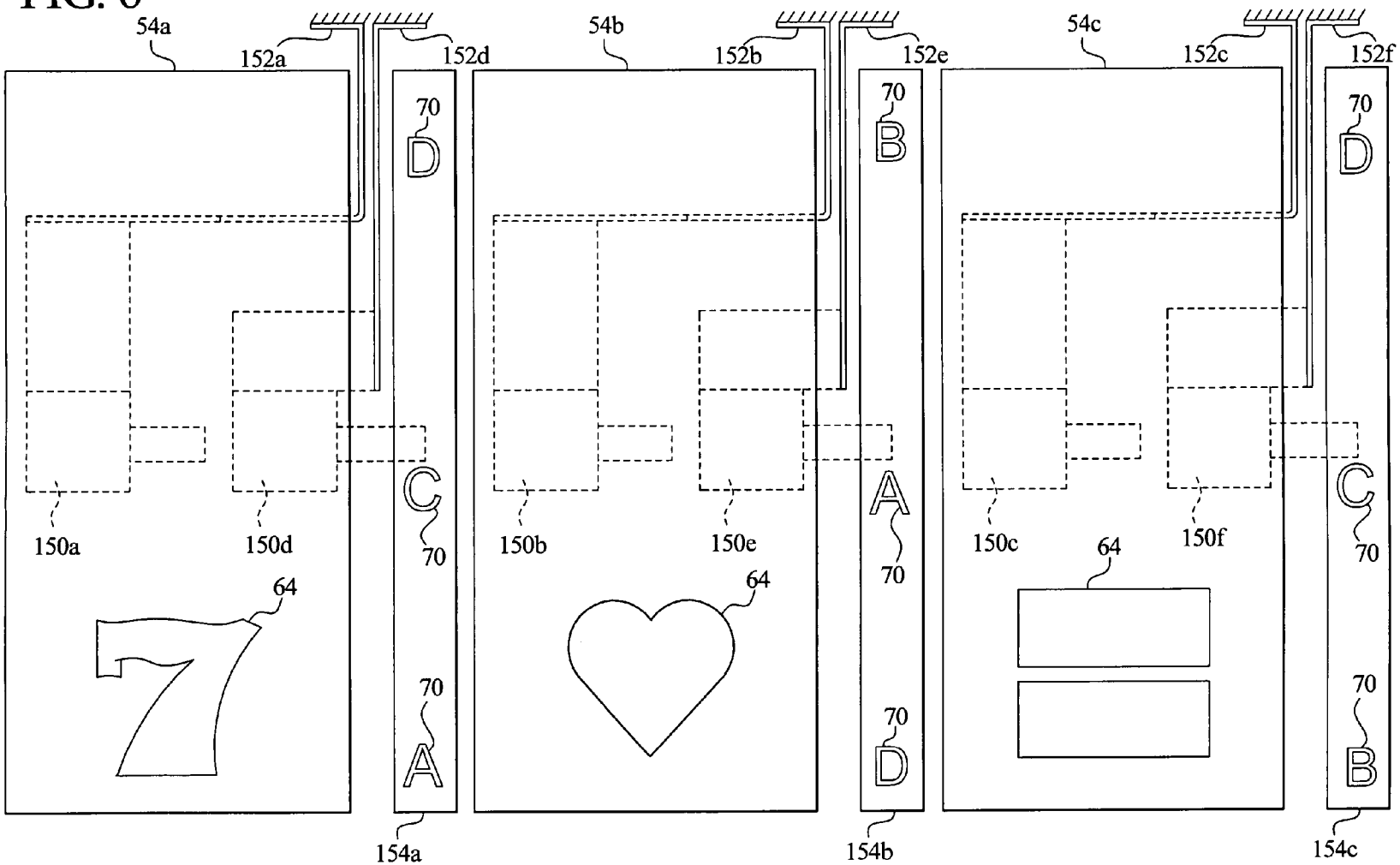
FIG. 6 is an elevation view of one embodiment for providing separate physical and electromechanical base game and secondary symbol reels.

Referring now to FIG. 6, an alternative electromechanical reel arrangement is illustrated. Here, three base game reels 54*a*, 54*b* and 54*c* are respectively positioned or placed adjacent to three thinner secondary reels 154*a*, 154*b* and 154*c*. The base game symbols 64 and secondary symbols 70 are generated so that each secondary symbol 70 is adjacent to, e.g., near the lower right hand corner of, and associated with a base game symbol 64. Alternatively, only certain base game symbols 64 have associated secondary symbols 70.

Motors 150*a* to 150*c* drive base game reels 54*a* to 54*c*, respectively. Each motor 150*a* to 150*c* is capable of generating a separate and independent outcome. Motors 150*d* to 150*f* drive secondary reels 154*a* to 154*c*, respectively. Each motor 150*d* to 150*f* is also capable of generating a separate and independent outcome.

Each motor 150*a* to 150*f* is connected to a suitable mount 152*a* to 152*f*, respectively. Mounts 152*a* and 152*d* fit between and extend from reels 54*a* and 154*a*. Mounts 152*b* and 152*e* fit between and extend from reels 54*b* and 154*b*. Mounts 152*c* and 152*f* fit between and extend from reels 54*c* and 154*c*. Mounts 152*a* to 152*f* secure motors 150*a* to 150*f* to a chassis or frame of gaming device 10. Mounts 152*a* to 152*f* in an embodiment also carry motor leads or electrical traces that power the respective motors 150*a* to 150*f*.

The six independent motors enable any combination of base and secondary reel movement and timing. The secondary reel stop positions are set in a desired relationship to the base reel stop positions so that the secondary symbols appear in a desired adjacent location, e.g., in a subscript type relationship, with respect to the base game symbols.

It should thus be appreciated that any suitable number of primary symbol and secondary symbol reels may be employed in the present invention.

Base Game Secondary Symbols Matched with Bonus Display Secondary Symbols

Referring now to FIGS. 7, 8, 9, 10, 11, 12 and 13, one primary embodiment of the present invention is illustrated. FIG. 7 illustrates one embodiment of a set of secondary symbols. FIG. 7 illustrates that each secondary symbol 70 is also associated with an award 76. The award 76 can be any suitable type of bonus award, such as a multiplier, a credit value, a number of free spins, a bonus pay environment such as a scatter pay and a non-monetary award such as a voucher for a drink, meal, etc. The secondary symbols 70 and associated awards 76 in one embodiment are equally weighted. Alternatively, the weighting probabilities 78 illustrate that the secondary symbols 70 and associated awards 76 can be non-equally weighted so that one or more of the secondary symbols and awards occurs more often than at least one other such symbol and award. In the illustrated embodiment, for example, the high and low ends of the payouts 76 associated with the secondary symbols of set A tend to be weighted lower than the middle award outcomes.

For ease of illustration, the bonus pay options of FIG. 8 are described in connection with a slot game. It should be appreciated, however, that each of the teachings illustrated in connection with FIGS. 8 to 13 are also applicable with other suitable base games such as poker, blackjack or other card game as well as keno. In connection with slot, the game of the present invention includes a plurality of main slot reels 54 and a bonus reel or display 84. Bonus reel or display 84 generates random outcomes separate from the random outcomes generated by reels 54. In the game of FIGS. 8 to 13, a bonus is provided for matches that occur between secondary symbols 70 generated on reels 54 and secondary symbols 70 generated on bonus reel or display 84. FIG. 8 highlights different ways to add to or multiply a base game win. FIGS. 9 to 13 shows which paystops on reels 54 are considered in determining whether a match occurs between secondary symbols 70 appearing on the reels and secondary symbols 70 generated in display 84. In any case or alternative embodiment, for the first primary embodiment a win is paid for a match between reels 54 and display 84.

As discussed, FIG. 8 illustrates a number of embodiments for how gaming device 10 pays the bonus award 76 in association with the secondary symbol 70 to the player. In the first embodiment listed in FIG. 8, the bonus pays are multipliers that multiply a line win. For example, the above slot game shows three paylines 52*a* to 52*c*. If a win occurs along payline 52*a* and an appropriate match occurs between one or more secondary symbols 70 appearing on reels 54 and on display 84 (for example if the paying combination of base game symbols are associated with any secondary symbols 70 that match the secondary symbol 70 generated on display 84), then the award 76 associated with the generated secondary symbol is multiplied by the number of credits produced by the winning symbol or symbol combination along the triggering payline. This can be done once for each award or can be done for each matching set of secondary symbols.

In the second embodiment listed in FIG. 8, the bonus win multiplies the highest payout occurring along any payline, not just the payout associated with a win occurring along the triggering payline. For example, if a win occurs along paylines 52*a* and 52*b* and an appropriate match occurs between secondary symbols 70 appearing on reels 54 and on display 84, then the award 76 associated with the generated secondary symbol is multiplied by the higher of the two payouts occurring on either payline 52*a* or 52*b*.

In the third embodiment listed in FIG. 8, the bonus win multiplies a sum of all payline wins. For example, if a win occurs along paylines 52*a* and 52*b* and an appropriate match occurs between secondary symbols 70 appearing on reels 54 and on display 84, then the award 76 associated with the generated secondary symbol is multiplied by the sum of the base game payouts occurring on paylines 52*a* or 52*b*.

As discussed above, the awards 76 can be credit values or types of awards other than multipliers. In the fourth embodiment listed in FIG. 8, a credit value or other type of award is paid in addition to the win along a triggering payline. For example, if a win occurs along payline 52*a* and an appropriate match occurs between secondary symbols 70 appearing on reels 54 and on display 84, then the award 76 associated with the generated secondary symbol is added to the number of credits produced by the winning symbol or symbol combination along the triggering payline.

In the fifth embodiment listed in FIG. 8, the bonus win is added to the highest payout occurring along any payline, not just the payout associated with a win occurring along the triggering payline. For example, if a win occurs along paylines 52*a* and 52*b* and an appropriate match occurs between secondary symbols 70 appearing on reels 54 and on display 84, then the award 76 associated with the generated secondary symbol is added to the higher of the two payouts occurring on either payline 52*a* or 52*b* In the sixth embodiment listed in FIG. 8, the bonus win is added to a sum of all payline wins. For example, if a win occurs along paylines 52*a* and 52*b* and an appropriate match occurs between secondary symbols 70 appearing on reels 54 and on display 84, then the award 76 associated with the generated secondary symbol is added to the sum of the base game payouts occurring on paylines 52*a* or 52*b*.

In the seventh embodiment listed in FIG. 8, the bonus payout is a stand alone payout that is provided separate from the base game payout. For example, if a win occurs along payline 52*a* and an appropriate match occurs between secondary symbols 70 appearing on reels 54 and on display 84, then the award 76 associated with the generated secondary symbol is provided in a manner that is separate from the provision of the base game payout. For example, the separate payout could be a non-monetary or other type of payout that is not combinable with the base game payout, such as a number of free spins, a free meal or beverage, a credit for merchandise or services located within the casino, etc.

As mentioned above, FIGS. 9 to 13 illustrate various embodiments for when the bonus payout is triggered or takes place. If the bonus payout is triggered in any of the embodiments described in FIGS. 9 to 13, the bonus payout can be according to any of the embodiments described in FIG. 8. For ease of illustration, each of the examples discussed below in connection with FIGS. 9 to 13 uses the first listed payout embodiment discussed in connection with FIG. 8, namely, wherein the bonus win is multiplied by the base game triggering line win.

Figure 9:
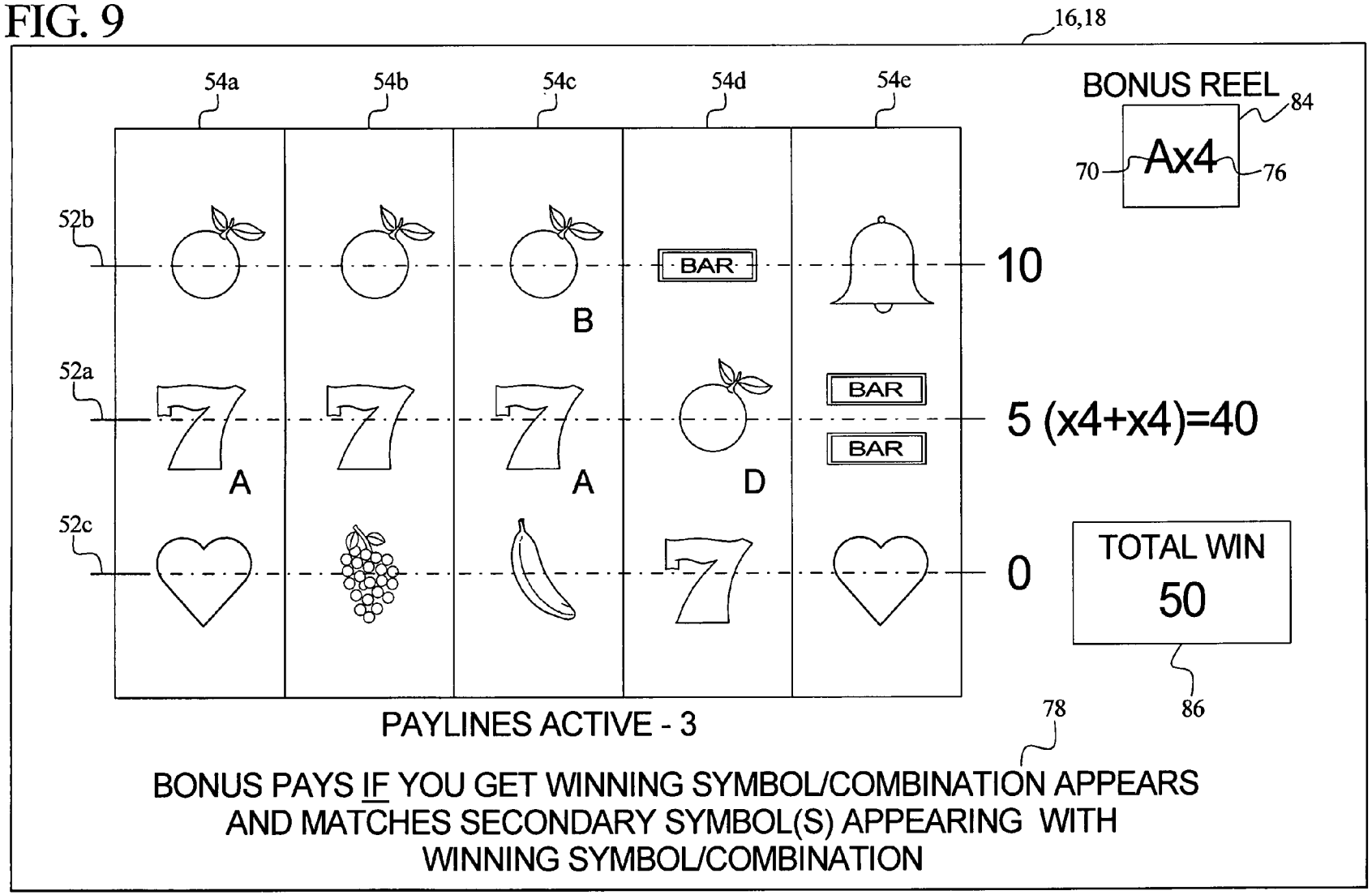
FIGS. 9, 10, 11, 12 and 13 are elevation views of one of the primary embodiments of the present invention illustrating various alternative examples of when the bonus payout occurs.

FIG. 9 illustrates an audio, visual or audiovisual message 78 which says that the bonus pays if the player gets a symbol or combination and the generated bonus symbol shown in bonus display 84 matches the winning symbol or one of the symbols of the winning combination. Here, if a match occurs between the secondary symbol 70 of display 84 and a secondary symbol 70 appearing along the winning payline but not as part of the winning combination, the bonus is not paid. Further, if a winning combination produces a secondary symbol that does not match the generated symbol, no bonus is paid to the player.

In FIG. 9, all three paylines are active. The player has won along paylines 52*a* and 52*b*. In one embodiment, the spinning or generation of bonus symbols in bonus symbol display 84 occurs only if a win along an active payline occurs. As illustrated, the player wins ten credits for the three fruit symbols occurring along line 52*b*. The player wins five credits for the three 7's occurring along line 52*a*. Of those two winning symbol combinations, secondary symbol B occurs in association with one of the fruit symbols occurring along payline 52*b*. Two secondary symbols A appear in association with two of the three paying 7 symbols appearing along payline 52*a*. The secondary symbol random generation produces the secondary symbol A in combination with an award of ×4 as seen in display 84. The player therefore receives no bonus in connection with the win along payline 52*b* but receives two ×4 multipliers in association with the paying symbols occurring along winning payline 52*a*. If the secondary symbol A had instead appeared in combination with one of the non-paying symbols occurring along winning payline 52*a* the player in the embodiment of FIG. 9 would not receive an award.

The bonus multipliers in this illustrated example add to form an overall ×8 multiplier, leading to a win along payline 52*a* of 40. In FIG. 9, the player therefore wins a total of fifty credits as seen in total win display 86. In an alternative embodiment the bonus multipliers act sequentially, namely, five credits is multiplied ×4 a first time yielding twenty credits after which the twenty credits is multiplied ×4 a second time yielding a total payout of eighty credits.

Figure 10:
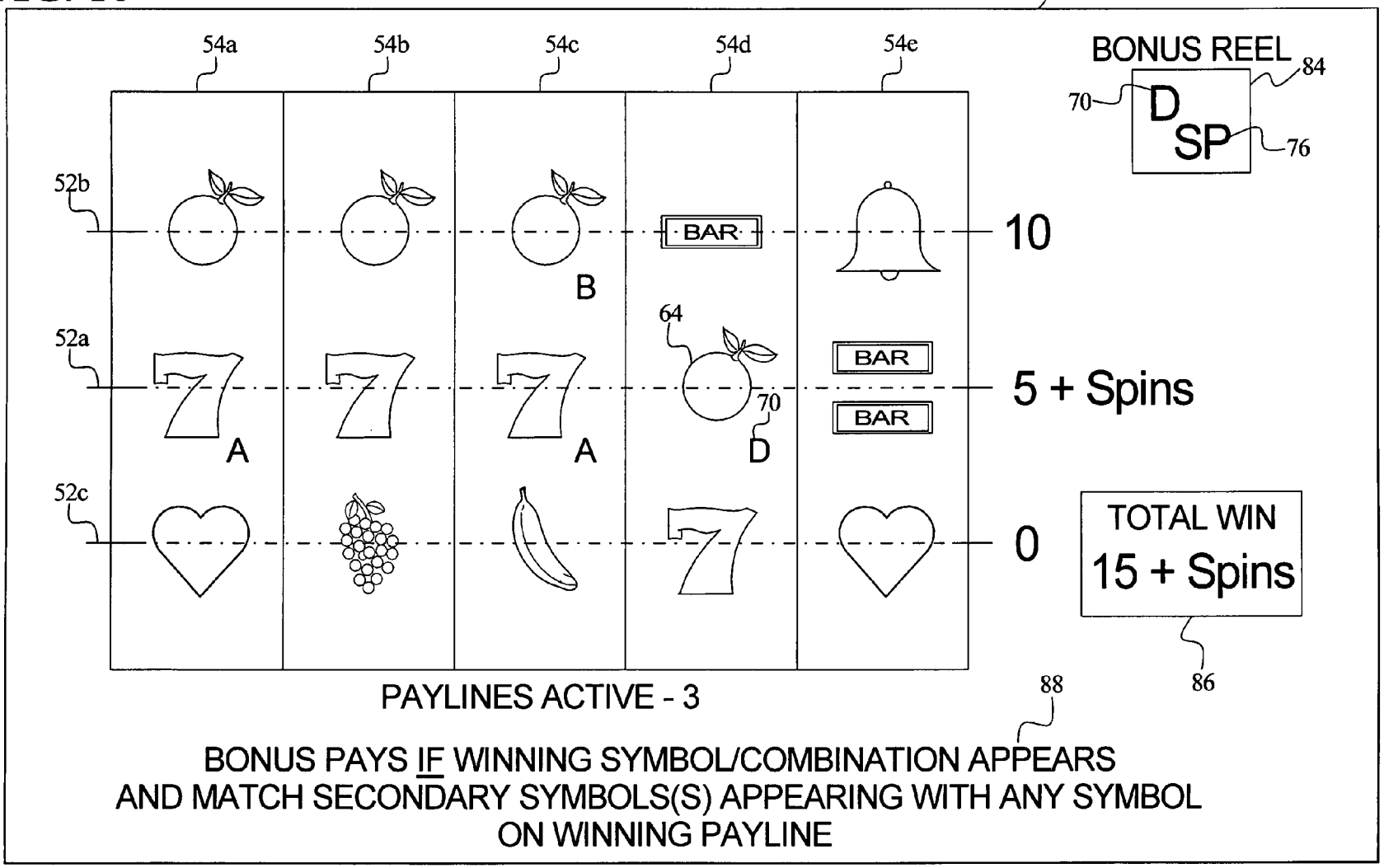

Audio, visual or audiovisual message 88 of FIG. 10 illustrates that in an alternative embodiment the player wins a bonus if the secondary symbol match occurs in association with any game symbol occurring along the triggering payline. Reels 54*a* to 54*e* show the same outcome in FIG. 10 as in FIG. 9. In particular, the player wins ten base game credits along payline 52*b* and five base game credits along payline 52*a*. The secondary symbol generation in FIG. 10, however, generates the D symbol 70 in combination with a bonus spin award 76. The player in this illustration receives the free spins for generating the non-paying fruit symbol 64 along payline 52*a* having an associated secondary symbol D. The bonus is paid despite the fact that the fruit or main game symbol 64 is not part of the 777 winning combination. That is, if the secondary symbol D had been generated in like manner in the embodiment of FIG. 9, the player would not have received the bonus spin award. In FIG. 10, however, total win display 86 shows that the player wins fifteen credits plus a number of free spins.

Figure 11:
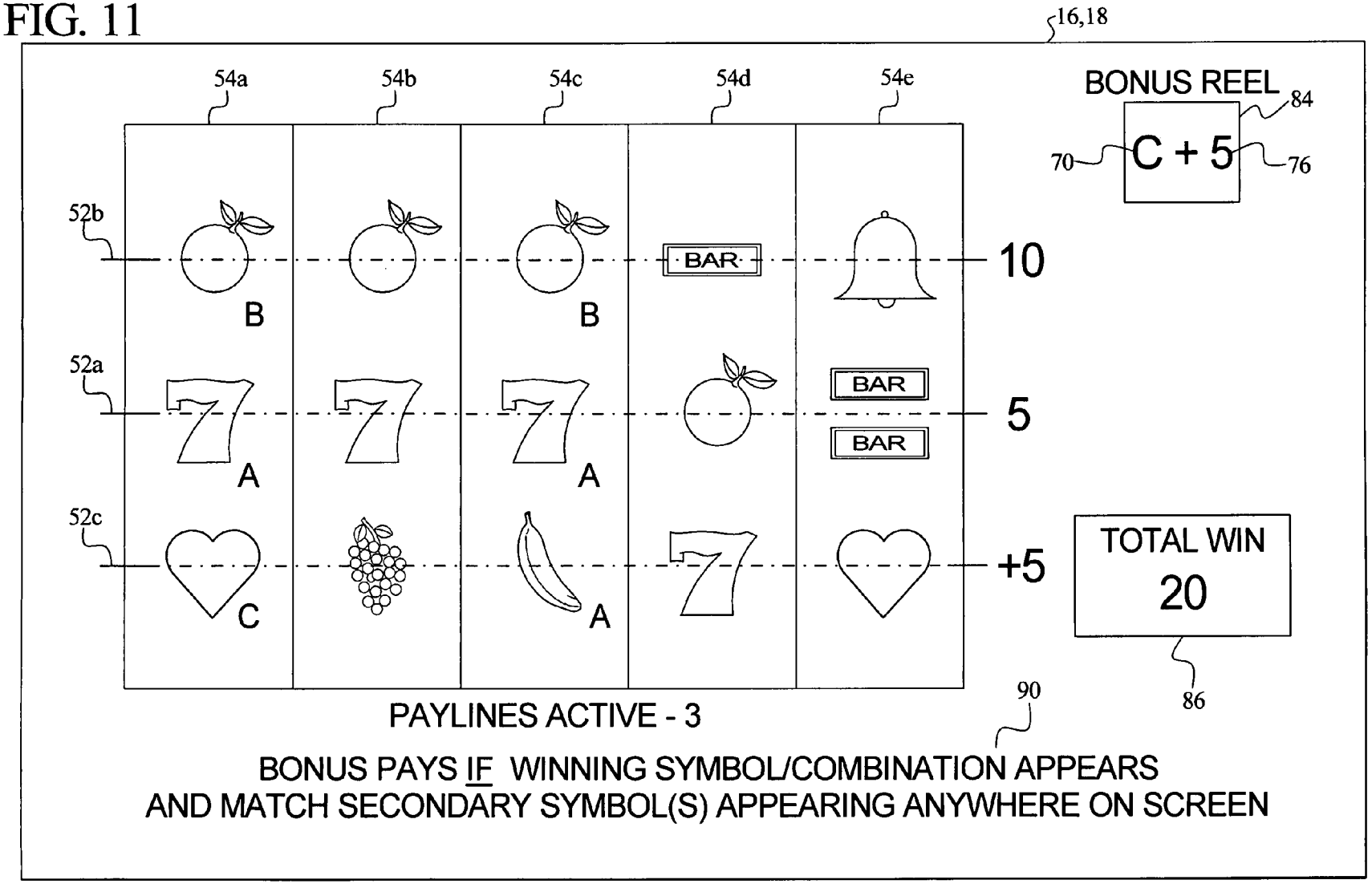

FIG. 11 illustrates another alternative embodiment. Audio, visual or audiovisual message 90 informs the player that the bonus is paid if the player obtains a winning symbol combination and a match anywhere on the main game screen, i.e., in the display areas 54*a* to 54*e*. Here, gaming device 10 generates base game wins along paylines 52*a* and 52*b* as above. Gaming device 10 does not generate a base game win along payline 52*c*. In one embodiment, the match must occur with a secondary symbol appearing on an active payline. In an alternative embodiment, the match can occur with a secondary symbol appearing on any payline, active or not. The base game win on the other hand must occur along an active payline.

As illustrated, all three paylines were activated. The bonus meter 84 shows that a secondary symbol 70 of C, along with a bonus award of +5 has been generated. Neither of the base game wins along 52*a* or 52*b* includes a main game symbol 64 associated with the secondary symbol 70 of C. Payline 52*c*, on the other hand, includes a symbol 64 associated with the secondary symbol C. The player is provided the bonus five credits in this embodiment, even though no base game win occurs along payline 52*c*.

Figure 12:
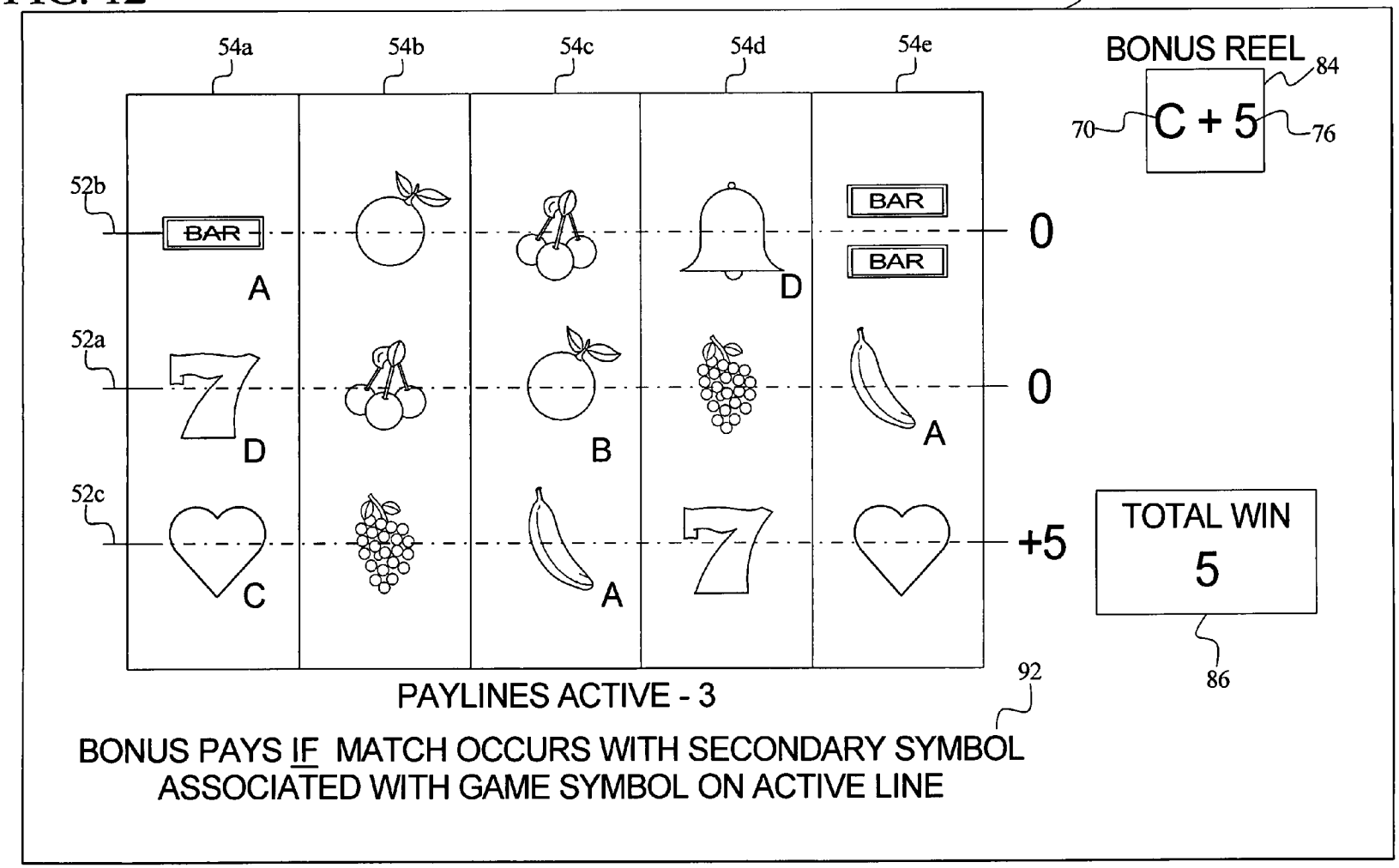

FIG. 12 illustrates another alternative embodiment. Here, message 92 informs that a bonus is paid if a match occurs along any active payline. Here the +5 credits are provided even though no base game win occurs along any of the paylines 52*a* to 52*c*. Importantly, however, all three paylines have been activated.

Figure 13:
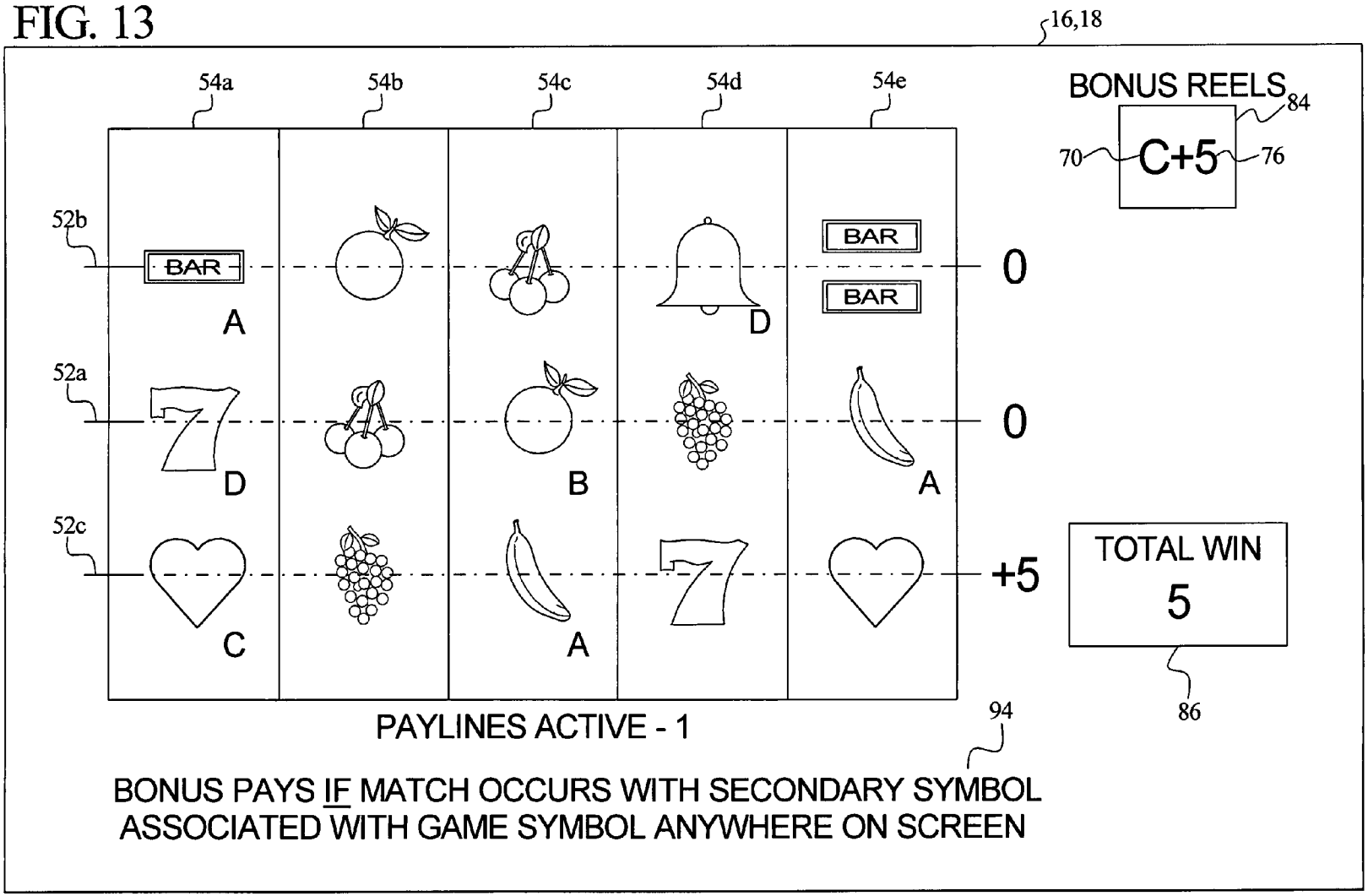

FIG. 13 illustrates a further alternative embodiment. Here, a bonus is paid if a match occurs, regardless of whether a base game win has occurred and regardless of how many paylines the player has played. The bonus of +5 credits is provided even though no base game win occurs on any of the paylines 52*a* to 52*c* and regardless of the fact that the match occurs on a symbol along payline 52*c* and only payline 52*a* has been activated.

It should be appreciated that many game combinations are provided when all the combinations of FIG. 8 are combined with all the combinations of FIGS. 9 to 13. The present invention contemplates providing a game having any suitable combination between the embodiments of FIG. 8 and the embodiments of FIGS. 9 to 13.

Multiple Reels Having Secondary Symbols

Figure 14:
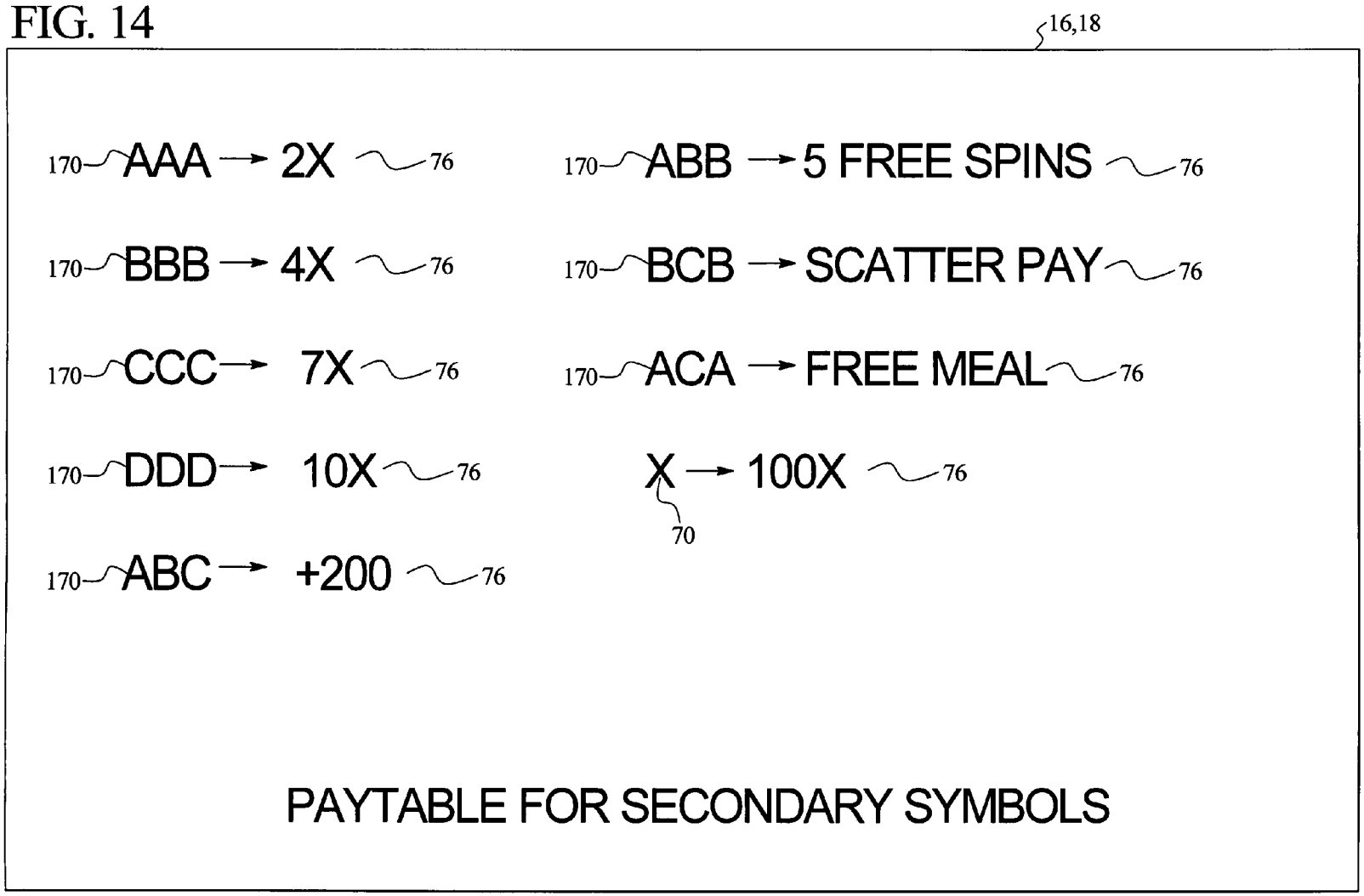
FIGS. 14, 15, 16, 17, 18 and 19 are elevation views of another of the primary embodiments of the present invention illustrating various alternative examples of when the bonus payout occurs.

Referring now to FIGS. 14, 15, 16, 17, 18 and 19, another primary embodiment of the present invention is illustrated. FIG. 14 illustrates one embodiment of a paytable of winning combinations 170 of secondary symbols 70. Combinations 170 are each associated with an award 76. The award 76 can be any suitable type of bonus award, such as a multiplier, a credit value, a number of free spins, a bonus pay such as a scatter pay and a non-monetary award such as a voucher for a drink, meal, etc. The secondary symbol combinations 170 and associated awards 76 in one embodiment are equally weighted. Alternatively, secondary symbol combinations 170 and associated awards 76 are non-equally weighted (e.g., via probabilities 78 described above in connection with FIG. 7) so that one or more of the combinations 170 and awards 76 is generated more often than at least one other such combination and award. While most combinations 170 are illustrated with three secondary symbols 70, combinations 170 alternatively have different or varying numbers of symbols 70. Further, a single symbol 70, as seen by the "X" symbol 70 in FIG. 14, can yield a payout.

In FIGS. 15 to 19 each of the generated base game symbols 64 is associated with a secondary symbol 70. Alternatively, only certain base game symbols 64 are associated with secondary symbols 70.

For ease of illustration, the bonus pay options of FIGS. 14 to 19 are described in connection with a slot game. It should be appreciated, however, that each of the teachings illustrated in connection with FIGS. 14 to 19 is also applicable with other base games, such as poker, blackjack or other card game as well as keno. In connection with slot, FIGS. 15 to 19 show three main slot reels 54*a* to 54*c* and three secondary reels 154*a* to 154*c*, the secondary reels (collectively 154) each show secondary symbols 70. Alternatively, secondary symbols are displayed in a fixed relationship with some or all of the base game symbols 64 on reels 54*a* to 54*c*, e.g., on video reels 54*a* to 54*c*. In such a case, the display of the secondary symbols 70 occurs with the random generations of reels 54 and base symbols 64. When secondary reels 154 are used, on the other hand, secondary reels 154*a* to 154*c* display random outcomes separate from the random outcomes of reels 54*a* to 54*c*.

Secondary reels 154*a* to 154*c* can be located directly adjacent to and associated with primary reels 54*a* to 54*c*, respectively, as illustrated. In an alternative embodiment, the secondary reels are concentric with and for example located inside primary reels 54*a* to 54*c*. In such a case, the background portion of reels 54*a* to 54*c* or reel strips are clear or transparent so that secondary reels can be seen. In another embodiment, reels 54*a* to 54*c* each provide multiple cutouts or windows so that secondary symbols 70 located behind reels 54*a* to 54*c* can be seen. In a further alternative embodiment, reels 54*a* to 54*c* and 154*a* to 154*c* are each simulated on a video monitor of one of display devices 16 or 18.

It should be appreciated from FIGS. 15 to 19 that in the second primary embodiment, bonus display 84 is not provided. Instead a bonus win meter 96 is shown.

In the game illustrated in FIGS. 15 to 19, a bonus is provided for winning combinations 170 of secondary symbols 70 generated on reels 54 (for fixed relationship between base and secondary symbols) or reels 154 (for random relationship between base and secondary symbols). The payouts discussed above in connection with FIG. 8 are also applicable to the embodiments of FIGS. 14 to 19. FIGS. 15 to 19 show which paystops on reels 154 are considered in determining whether one of the paying combinations 170 (or the winning "X" symbol 70) occurs.

Figure 15:
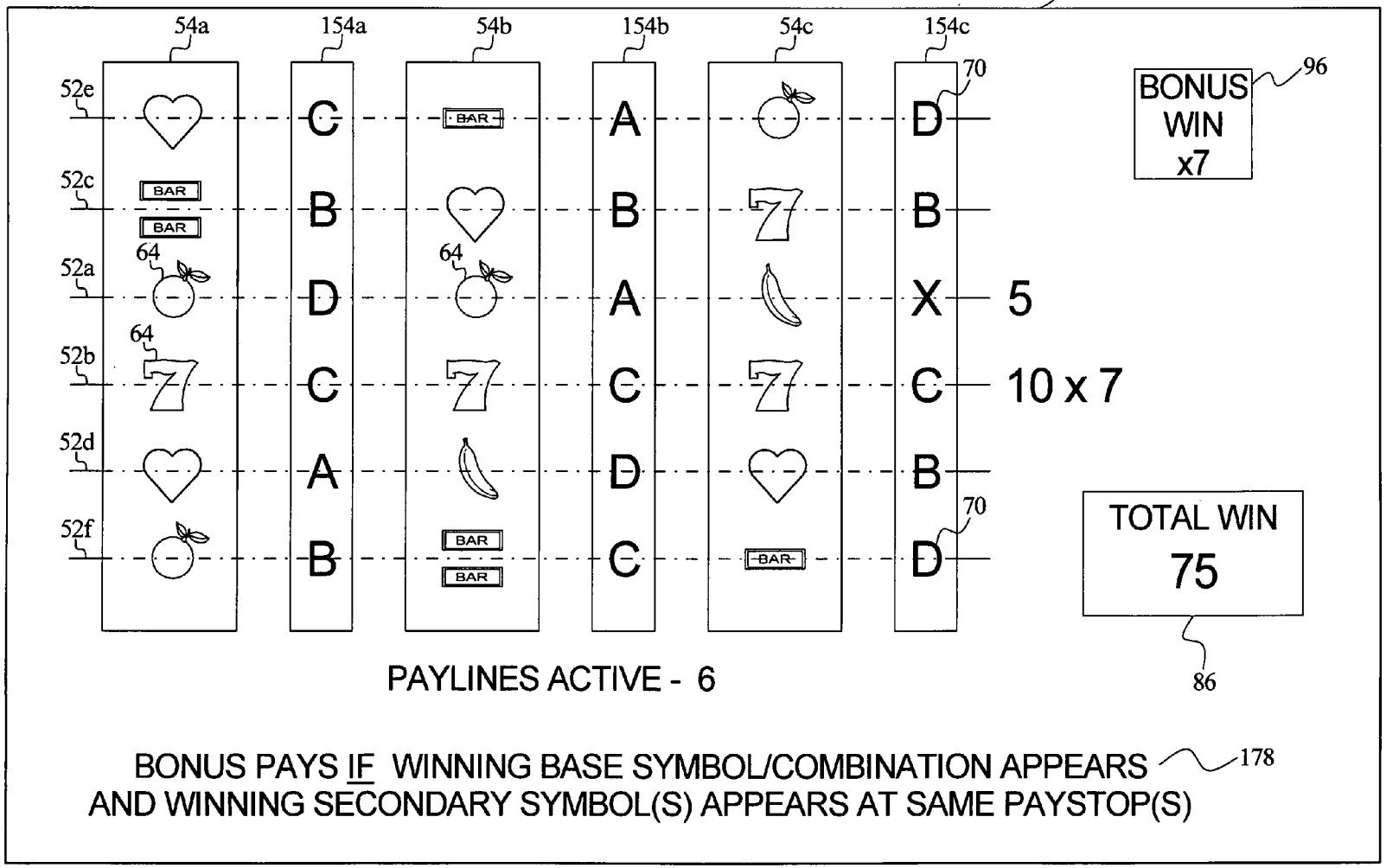

FIG. 15 illustrates an audio, visual or audiovisual message 178 that says that the bonus pays if the player obtains a paying base game symbol or combination and one of the winning secondary combinations 170 (or X symbol 70) appears with or in association with the paying base game symbols. Here, if the paying secondary symbol(s) 70 appear along a winning payline but not in direct association with one of the paying base game symbols, the bonus is not paid. Further, if a winning combination 170 of secondary symbols 70 is produced in association with a non-winning combination of base game symbols 64, no bonus is paid to the player.

In FIG. 15, all six paylines 52*a* to 52*f* are active. The player has won in the base game along paylines 52*a* and 52*b* (five credits for two cherries and ten credits for three sevens). Of those two winning symbol combinations, secondary symbol combination "C, C, C" occurs on reels 154*a* to 154*c* along payline 52*b* in association with the three paying base game 7 symbols 64 occurring along payline 52*b*. The paying secondary X symbol 70 appears along winning base game payline 52*a* but not in direct association with one of the paying cherry symbols 64. The player therefore receives no bonus in connection with the win along payline 52*a* but receives a ×7 multiplier (in accordance with the paytable of FIG. 14 for the "C, C, C" combination 170) in association with the base game win of ten credits occurring along winning payline 52*b*. If the secondary X symbol 70 had instead appeared in combination with one of the paying cherry symbols occurring along winning payline 52*a*, the player in the embodiment of FIG. 15 would receive an additional bonus award. As seen in bonus win meter 96 and total win meter 86, the bonus win is a ×7 multiplier and the total win is seventy-five credits, respectively.

Figure 16:
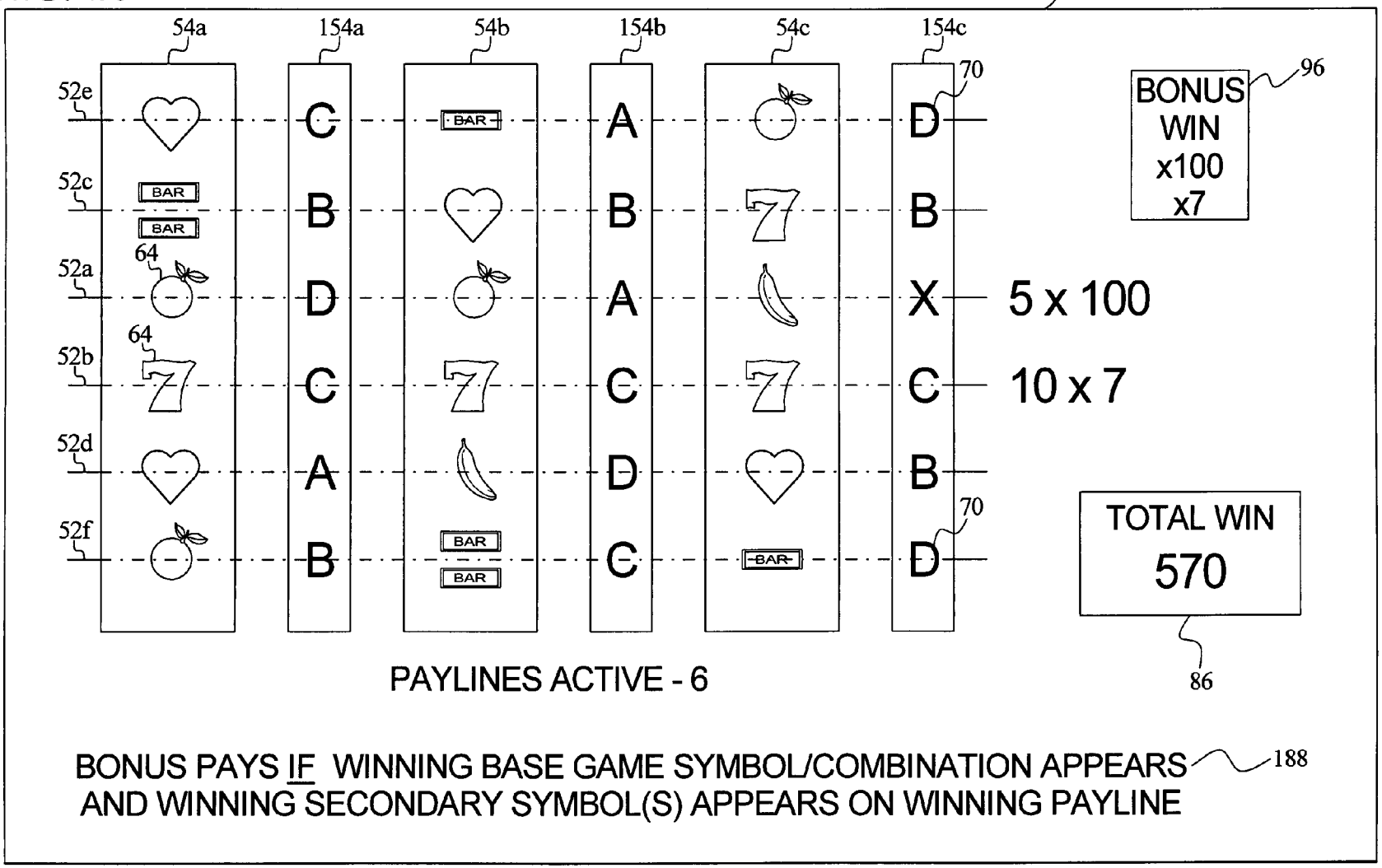

Audio, visual or audiovisual message 188 of FIG. 16 illustrates that in an alternative embodiment the player wins a bonus if the paying secondary symbol combination 170 occurs in association with any game symbol occurring along a paying base game payline. Reels 54*a* to 54*c* show the same outcome in FIG. 16 as in FIG. 15. In particular, the player wins ten base game credits along payline 52*b* and five base game credits along payline 52*a*. The secondary symbol generation in FIG. 16 yields a ×7 multiplier for the "C, C, C" combination 170 appearing in connection with payline 52*b* and a ×100 multiplier for the X symbol 70 appearing in connection with winning payline 52*a*.

The ×100 bonus is paid for the X symbol 70 despite the fact that the X symbol 70 is not directly associated with one of the paying base game cherries 64 appearing along payline 52*a*. Furthermore, the player does not receive a bonus along payline 52*c* even though the payline shows a "B, B, B" combination 170 because no base game win has been generated along that payline. As seen in bonus win meter 96 and total win meter 86, the bonus win is a ×7 and a ×100 multiplier and the total win is five hundred-seventy credits, respectively. In an alternative embodiment, the multipliers are summed to form a total multiplier ×107 shown in meter 96. The base game line wins are also summed and the two sums are multiplied to form the total win in meter 86.

Figure 17:
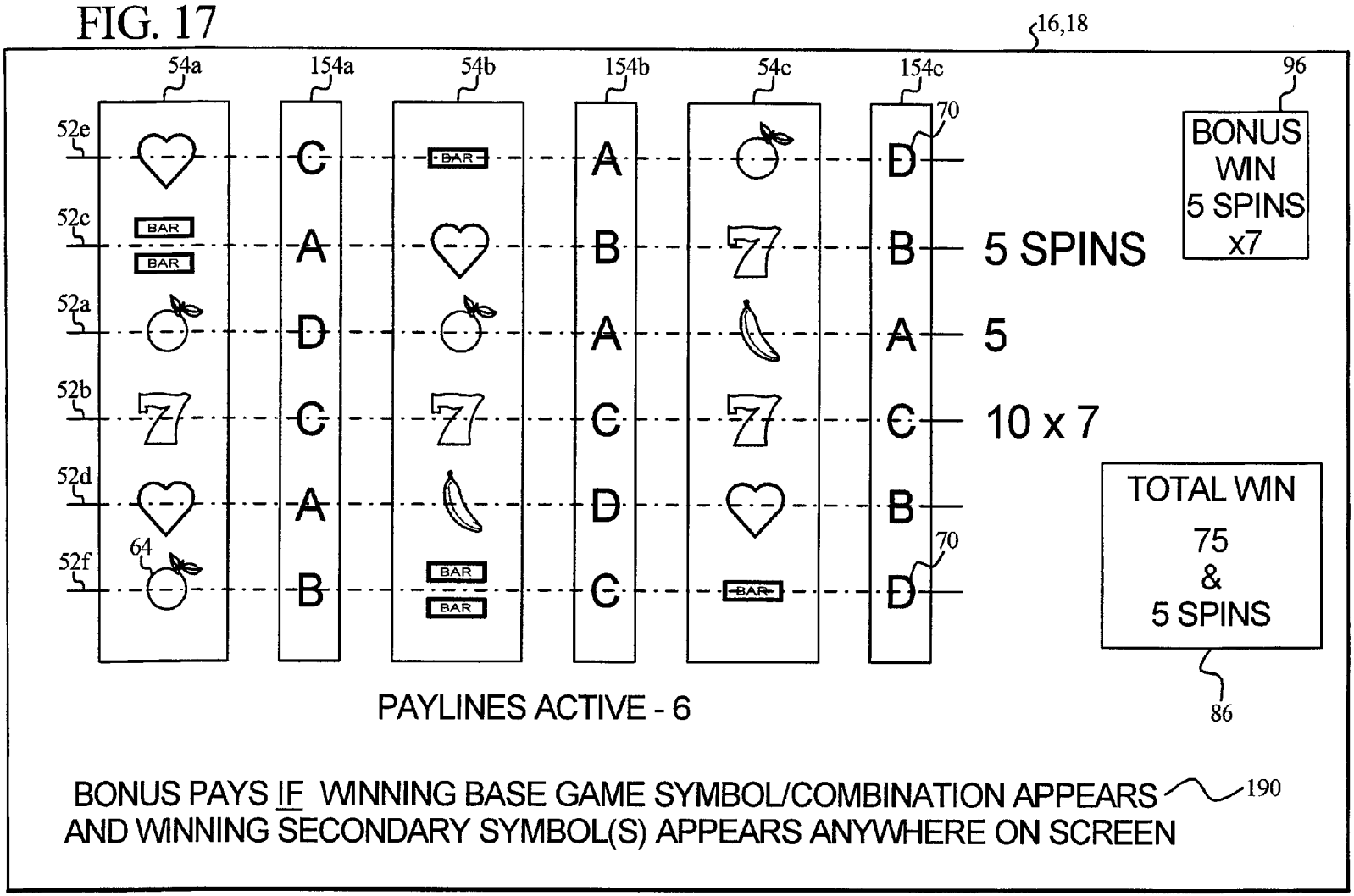

FIG. 17 illustrates another alternative embodiment. Audio, visual or audiovisual message 190 informs the player that the bonus is paid if the player obtains a winning base game symbol combination and a paying secondary symbol combination 170 appearing anywhere on the main game screen 16 or 18. Here, gaming device 10 generates base game wins along paylines 52*a* and 52*b* as above. Gaming device 10 does not generate a base game win along payline 52*c*.

As illustrated, all six paylines have been activated. The secondary symbol generation in FIG. 17 yields a ×7 multiplier for the "C, C, C" combination 170 appearing in connection with payline 52*b* and a five free spins bonus (for the "A, B, B" combination 170) appearing in connection with the non-winning payline 52*c*. Because gaming device 10 generated base game wins along paylines 52*a* and 52*b* (only one win needed), the player wins the bonus associated with reels 154*a* to 154*c* of payline 52*c*. It should be appreciated that if the payout scheme multiplies a bonus multiplier by a line win (and if the bonus in connection with payline 52*c* is instead a multiplier), then no bonus is paid because payline 52*c* does not generate a base game win. As seen in bonus win meter 96 and total win meter 86, the bonus win is a ×7 and five free spins and the total win is seventy-five credits and five free spins, respectively.

Figure 18:
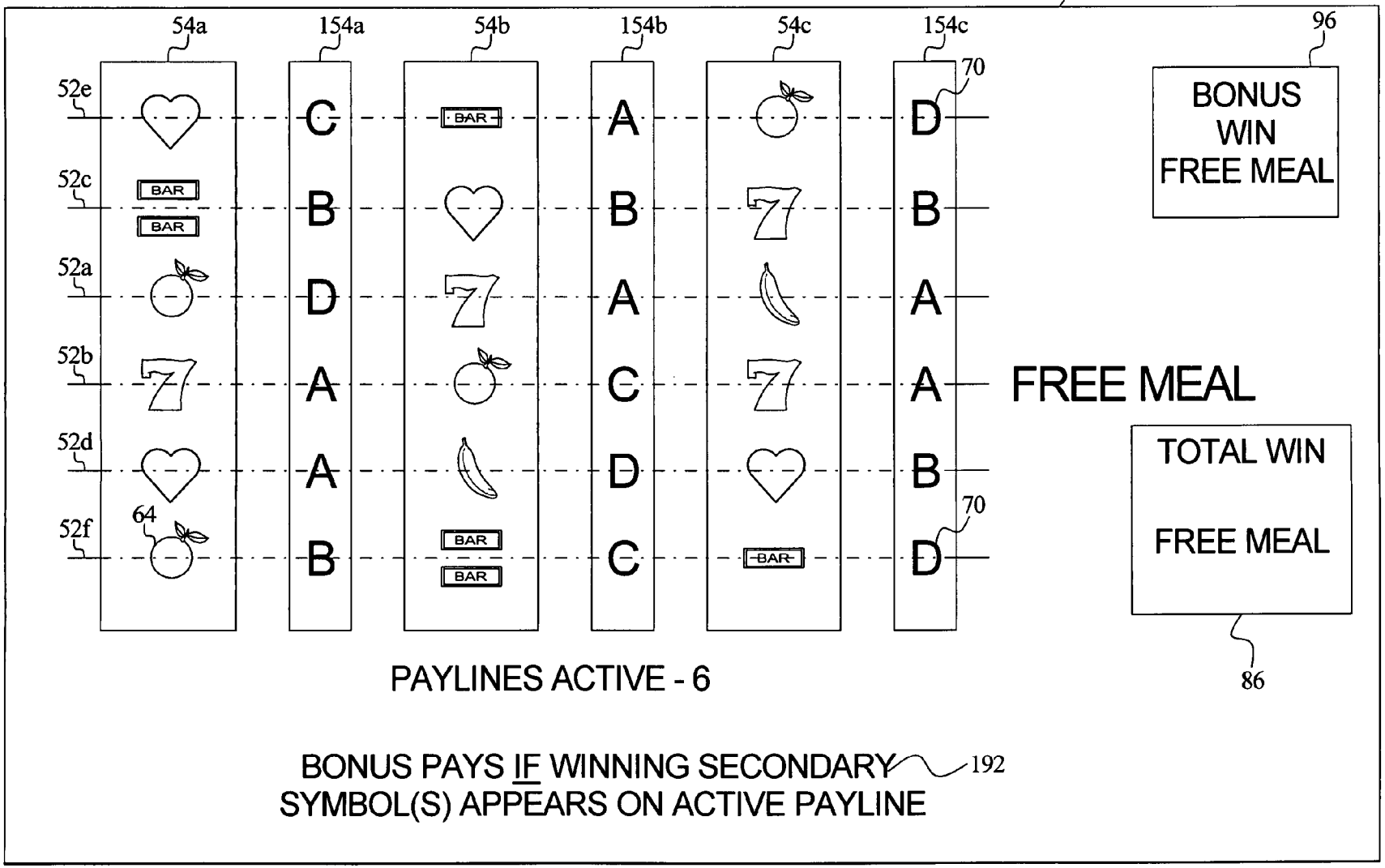

FIG. 18 illustrates a further alternative embodiment. Here, message 192 informs the player that a bonus is paid if a paying secondary symbol 170 is generated along any active payline. Here, a free meal is provided from the "A, C, A" paying combination 170 appearing along payline 52*b* even though no base game win occurs along any of the six paylines 52*a* to 52*f*. Importantly, however, all six paylines have been activated as seen in display device 16 or 18. The "A, C, A" paying combination 170 appears along an active payline 52*b* and is therefore eligible for payment.

As seen in bonus win meter 96 and total win meter 86, the bonus and total win is a free meal, respectively. It should be appreciated that a bonus multiplier would yield no award here if no base game win is generated.

Figure 19:
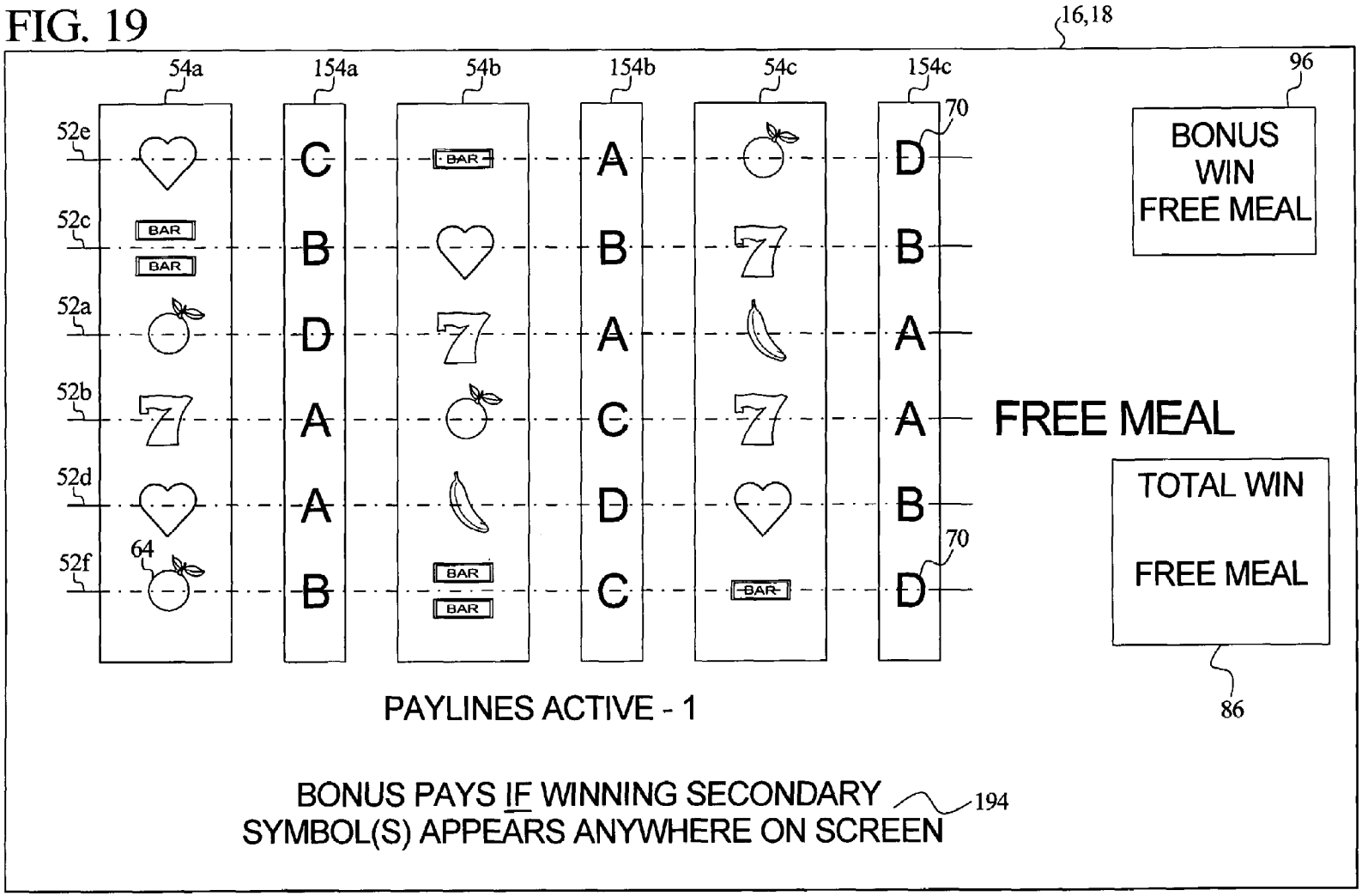

FIG. 19 illustrates a further alternative embodiment. Here a bonus is paid if a secondary winning combination appears along any payline, regardless of whether a base game win has occurred and regardless of how many paylines the player has played. Here, a free meal is provided from the "A, C, A" paying combination 170 appearing along payline 52*b* even though no base game win occurs along any of the six paylines 52*a* to 52*f*. Importantly, however, only payline 52*a* is active for the base game generation (only one payline active, payline 52*a*). As seen in bonus win meter 96 and total win meter 86, the bonus and total win is a free meal, respectively. It should be appreciated again that a bonus multiplier would yield no award here if no base game win is generated.

It should be appreciated that many game combinations are provided when all the payout combinations of FIG. 8 are combined with all the combinations of FIGS. 14 to 19. The present invention contemplates providing a game having any suitable combination between the embodiments of FIG. 8 and the embodiments of FIGS. 14 to 19.

Combined Secondary Associated Reels and Separate Secondary Reel

Referring now to FIGS. 20, 21, 22, 23, 24 and 25, a further primary embodiment of the present invention is illustrated, which combines the previous two primary embodiments. That is, the bonus symbols 70 generated in the separate bonus display 84 of the first primary embodiment are used in addition to the combinations 170 previously described in connection with the second primary embodiment.

Figure 20:
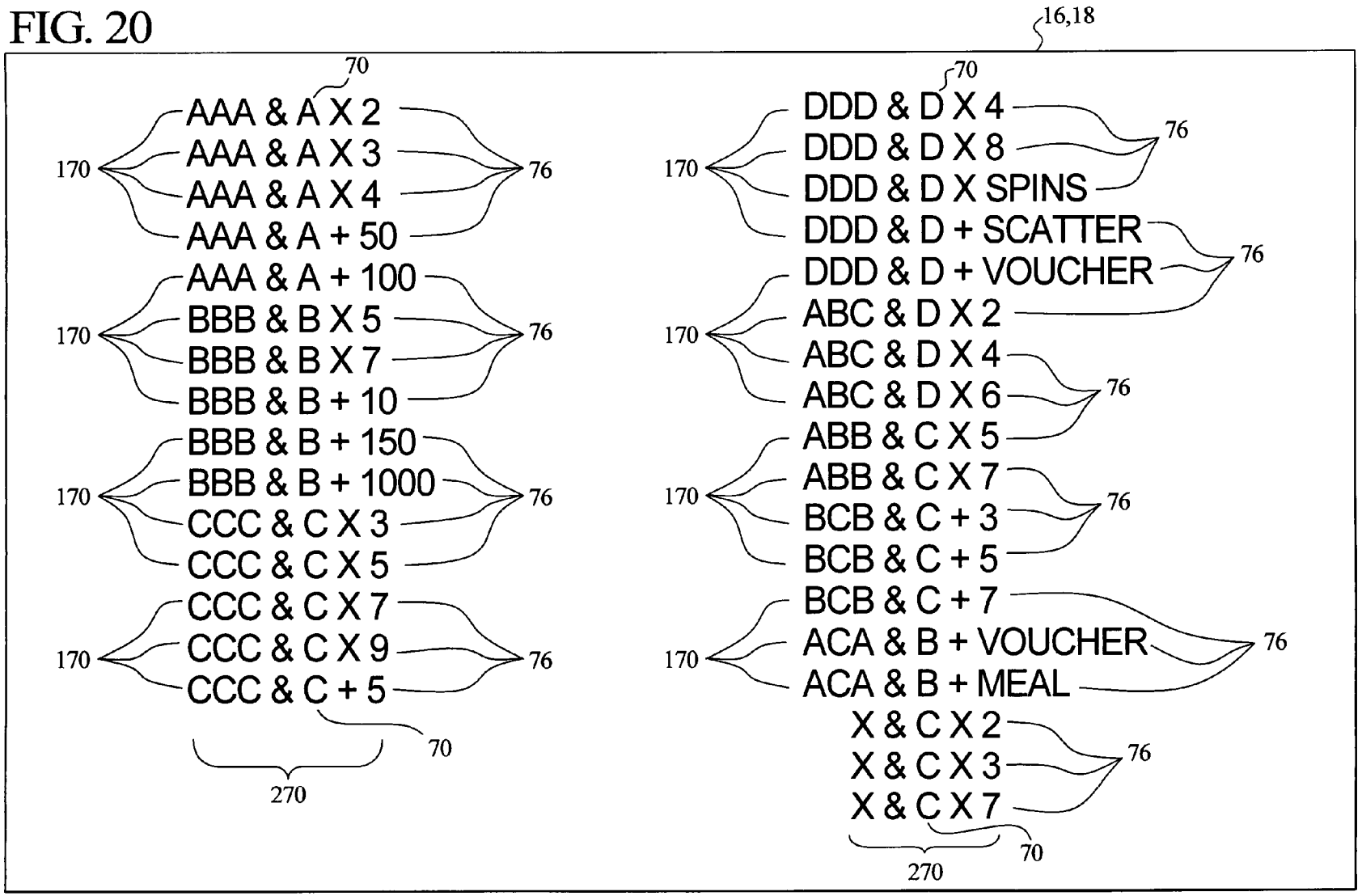
FIGS. 20, 21, 22, 23, 24 and 25 are elevation views of a further of the primary embodiments of the present invention illustrating various alternative examples of when the bonus payout occurs.

FIG. 20 illustrates one embodiment of a paytable of winning combinations 270, which includes combinations 170 of secondary symbols 70 paired with secondary symbols 70 generated in bonus generation display 84. Secondary symbols 70 generated in bonus generation display 84 are each associated with an award 76 as discussed in the first primary embodiment. The award 76 can be any suitable type of bonus award, such as a multiplier, a credit value, a number of free spins, a bonus pay such as a scatter pay and a non-monetary award such as a voucher for a drink, meal, etc. Alternatively (not illustrated), awards 76 are not associated with the symbols 70 of reel 84 and instead a paytable of payouts for the various overall combinations 270 is employed (as above in connection with the second primary embodiment of FIGS. 14 to 19). FIG. 20 illustrates that the same combination 270 of symbols 70 from combinations 170 and display 84 can yield different awards 76. For example, the overall AAAA combination 270 yields one of the awards selected from ×2, ×3, ×4, fifty credits and one hundred credits.

Secondary symbols 70 generated in display 84 are combined with secondary symbol combinations 170 (which themselves include secondary symbols 70) generated in association with the base game symbols, to form overall combinations 270. In one embodiment overall combinations 270 are equally weighted. Alternatively, combinations 270 are non-equally weighted (e.g., via probabilities 78 shown above in FIG. 7) so that one or more of the combinations 270 occurs more often than at least one other such combination 270. While most constituent combinations 170 are illustrated having three secondary symbols 70, combinations 170 alternatively have different or varying numbers of symbols 70. Further, a single secondary symbol 70 generated in association with the base game reels, as seen by the "X" symbol 70, in combination with a symbol 70 from separate reel 84 can yield a payout.

In FIGS. 21 to 25, each of the base game symbols 64 generated on reels 54*a* to 54*c* is associated with a secondary symbol 70 generated on associated reels 154*a* to 154*c*. Alternatively, only certain base game symbols 64 are associated with secondary symbols 70.

For ease of illustration, the bonus pay options of FIGS. 20 to 25 are described in connection with a slot game. It should be appreciated, however, that the teachings illustrated in connection with FIGS. 20 to 25 are also applicable with other base games, such as poker, blackjack or other card games as well as keno. In connection with slot, FIGS. 21 to 25 show three main slot reels 54*a* to 54*c* and three secondary reels 154*a* to 154*c*. The secondary reels (collectively 154) each display secondary symbols 70.

Alternatively, secondary symbols are displayed in a fixed relationship with some or all of the base game symbols 64 on reels 54*a* to 54*c* (e.g., on video reels 54). In such a case, the generation of secondary symbols 70 occurs with the random generations of reels 54 and base symbols 64. Secondary reels 154*a* to 154*c* are not needed. When secondary reels 154 are used, on the other hand, secondary reels 154*a* to 154*c* generate random outcomes separate from the random outcomes of reels 54*a* to 54*c*.

Secondary reels 154*a* to 154*c* can be located directly adjacent to and associated with primary reels 54*a* to 54*c*, respectively, as illustrated. In an alternative embodiment, the secondary reels are concentric to and for example located inside primary reels 54*a* to 54*c*. With concentric reels, the background portion of primary reels 54*a* to 54*c* can be clear or transparent so that the secondary reels can be seen. In another embodiment, primary reels 54*a* to 54*c* each provide multiple cutouts or windows so that secondary symbols 70 located behind primary reels 54*a* to 54*c* can be seen. In a further alternative embodiment, reels 54*a* to 54*c* and 154*a* to 154*c* are each simulated on a video monitor of one of display devices 16 or 18.

In this third primary embodiment, bonus display 84 is used. Bonus reel or display 84 generates random outcomes separate from the random outcomes generated by primary reels 54 and secondary reels 154. In the game of FIGS. 20 to 25, a bonus is provided when an overall paying combination 270 of secondary symbols 70 from combination 170 and separate display 84 is achieved. Reel or display 84 in the illustrated embodiment shows only one generated symbol 70. In an alternative embodiment, reel or display 84 shows a plurality of secondary symbols 70, wherein the secondary symbol generated for the player is highlighted via a payline or other visual marker.

The payout options discussed above in connection with FIG. 8 are applicable to the embodiments of FIGS. 20 to 25. FIGS. 21 to 25 show different embodiments for which pay-stops on reels 154 are considered in determining whether one of the paying combinations of secondary symbols occurs.

Figure 21:
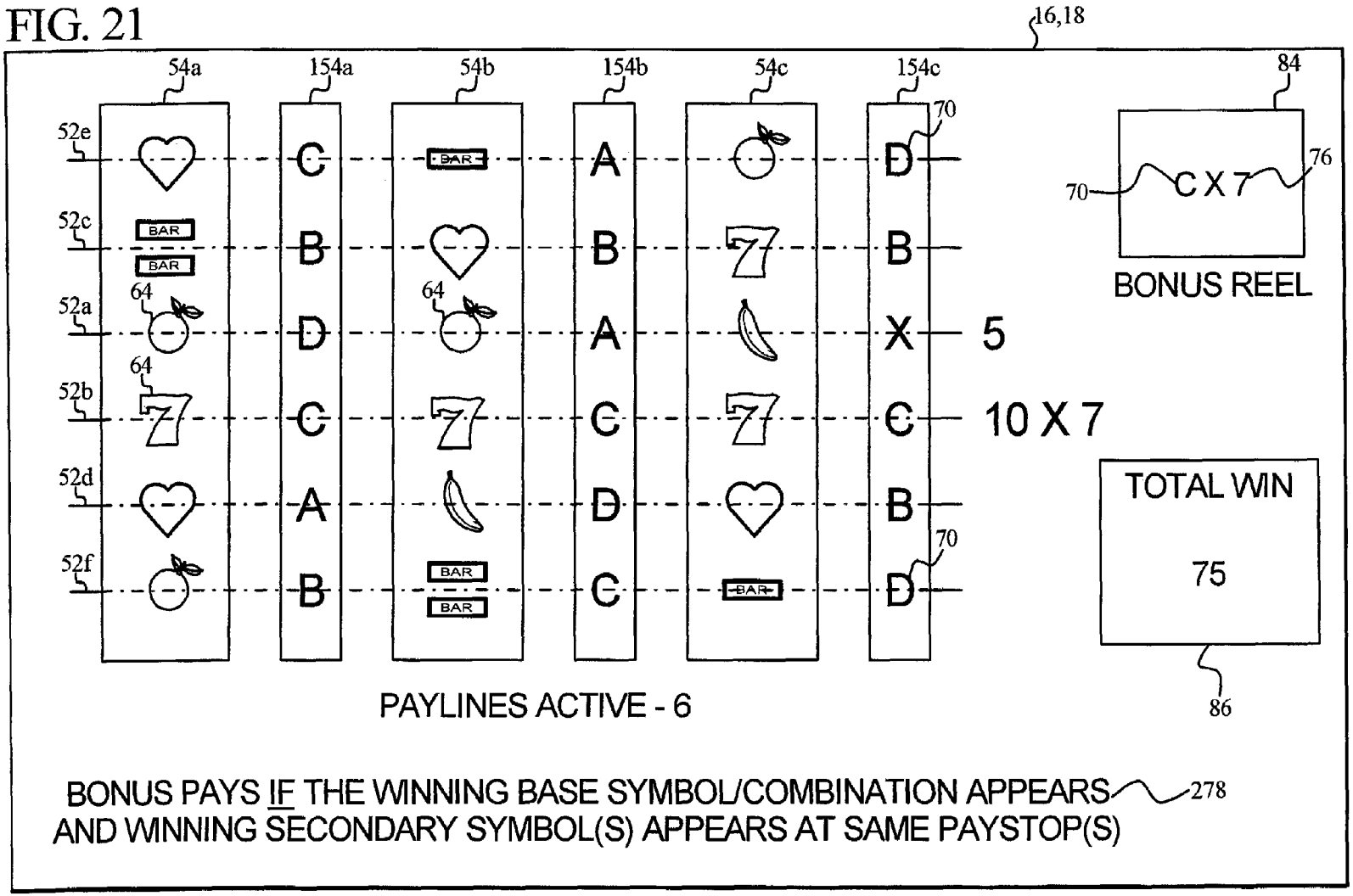

FIG. 21 illustrates an audio, visual or audiovisual message 278 including that the bonus pays if the player obtains a paying base game symbol or combination and one of the winning overall combinations 270 appears with or in association with the paying base game symbols. Here, if the paying secondary symbol(s) 70 occur along a winning payline but not in direct association with one of the paying base game symbols, the bonus is not paid. Further, if a winning combination 270 of secondary symbols 70 is produced in association with a non-winning combination of base game symbols 64, no bonus is paid to the player.

In FIG. 21, all six paylines 52*a* to 52*f* are active. The player has won in the base game along paylines 52*a* and 52*b* (five credits for two cherries and ten credits for three sevens). Of those two winning symbol combinations, payline 52*b* generates a portion of the "C, C, C, C" secondary symbol combination 270, three of which occur on reels 154*a* to 154*c* in association with the three paying base game 7 symbols 64. The fourth "C" symbol 70 appears on reel 84 as does the bonus win 76 of ×7. According to the paytable of FIG. 20, the fourth "C" symbol 70 could alternatively appear in combination with a bonus win 76 of ×3, ×5, ×9 and +5. When only one combination 270 is generated, it is possible to display the associated payout 76 (e.g., ×7) in display 84. Because the paytable of FIG. 20 has different payouts for different combinations 270 ending with the "C" secondary symbol 270, the payout 76 in one embodiment is not displayed in display 84 when two or more combinations 270 are generated at one time.

On the other hand, the paying secondary combination 270 of "X, C" appears along winning base game payline 52*a* but not in direct association with one of the paying cherry symbols 64. The player therefore receives no bonus in connection with the win along payline 52*a* but receives an ×7 multiplier (in accordance with one of the "C, C, C, C" combinations 270 in the paytable of FIG. 20) in association with the base game win of ten credits occurring along winning payline 52*b*. If the secondary symbol X had instead appeared in combination with one of the paying cherry symbols occurring along winning payline 52*a*, the player in the embodiment of FIG. 21 would receive an additional bonus award from the paytable of FIG. 20. As seen in total win meter 86, the total win is seventy-five credits.

Figure 22:
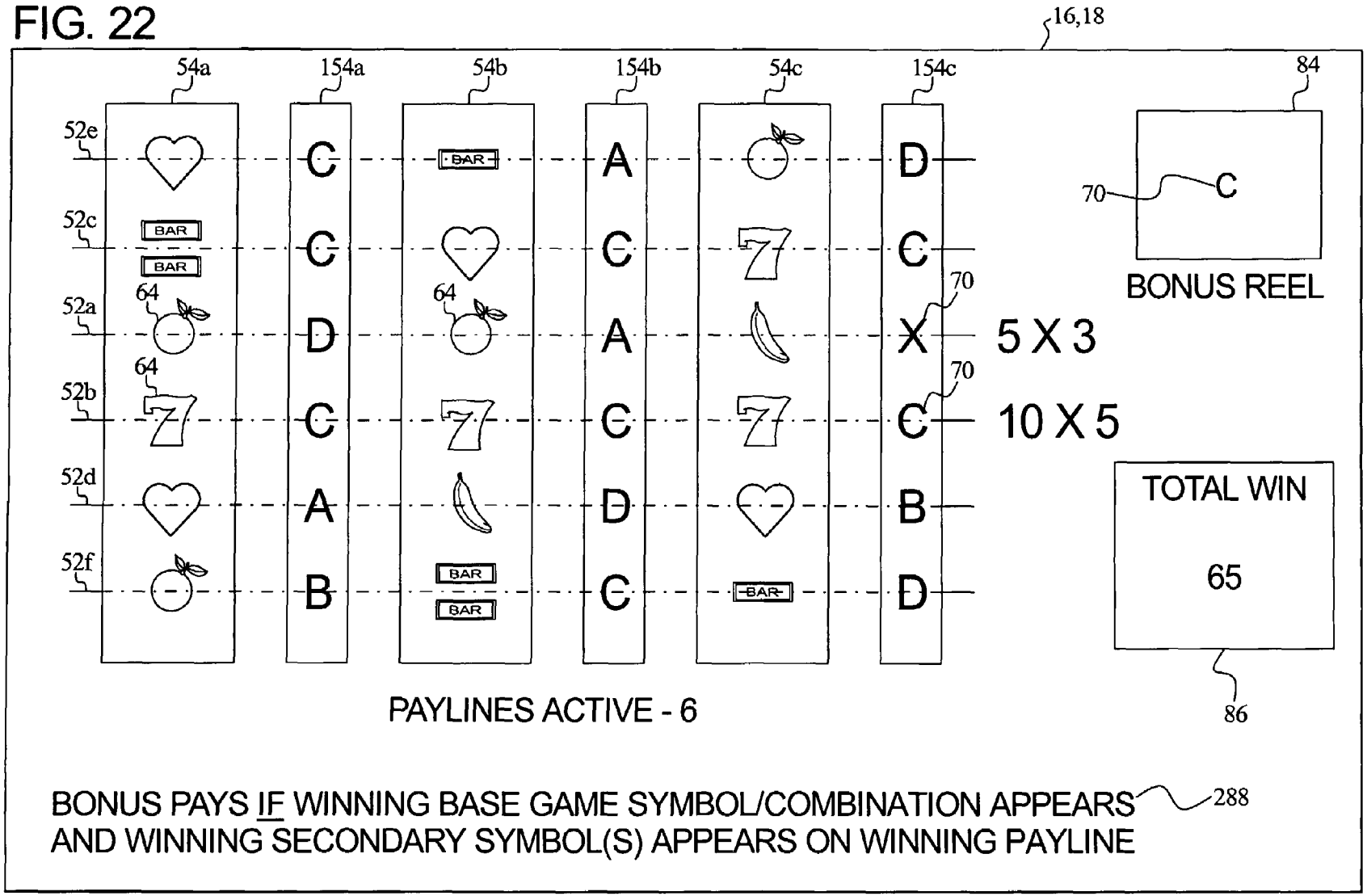

Audio, visual or audiovisual message 288 of FIG. 22 illustrates that in an alternative embodiment the player wins a bonus if the paying secondary symbol combination 270 occurs in association with any game symbol occurring along a paying base game payline. Reels 54*a* to 54*c* show the same outcome in FIG. 22 as in FIG. 21. In particular, the player wins ten base game credits along payline 52*b* and five base game credits along payline 52*a*. The secondary symbol generation in FIG. 22 yields (i) an ×5 multiplier for one of the "C, C, C, C" combinations 270 of the paytable of FIG. 20 appearing in connection with payline 52*b* and reel 84 and (ii) an ×3 multiplier for one of the "X, C" combinations 270 of the paytable of FIG. 20 appearing along payline 52*a* and reel 84. As illustrated, display 84 shows only the secondary "C" symbol 70 and not the accompanying award 76 which enables different pays for the same combination 270 to be generated at the same time.

The second ×3 bonus is paid for the "X, C" combination 270 despite the fact that the X symbol 70 is not directly associated with one of the paying base game cherries 64 appearing along payline 52*a*. Also, the player does not receive a bonus for the "C, C, C, C" combination 270 appearing along payline 52*c* and reel 84 because no base game win has been generated along that payline. As seen in total win meter 86 of FIG. 22, the total win is ((5×3)+(10×5)) sixty-five credits. In an alternative embodiment, (i) the multipliers are summed to form a total multiplier, e.g., ×8, (ii) the base game line wins are also summed, e.g., 15, and (iii) the two sums are multiplied to form the total win in meter 86, e.g., one hundred-twenty credits.

Figure 23:
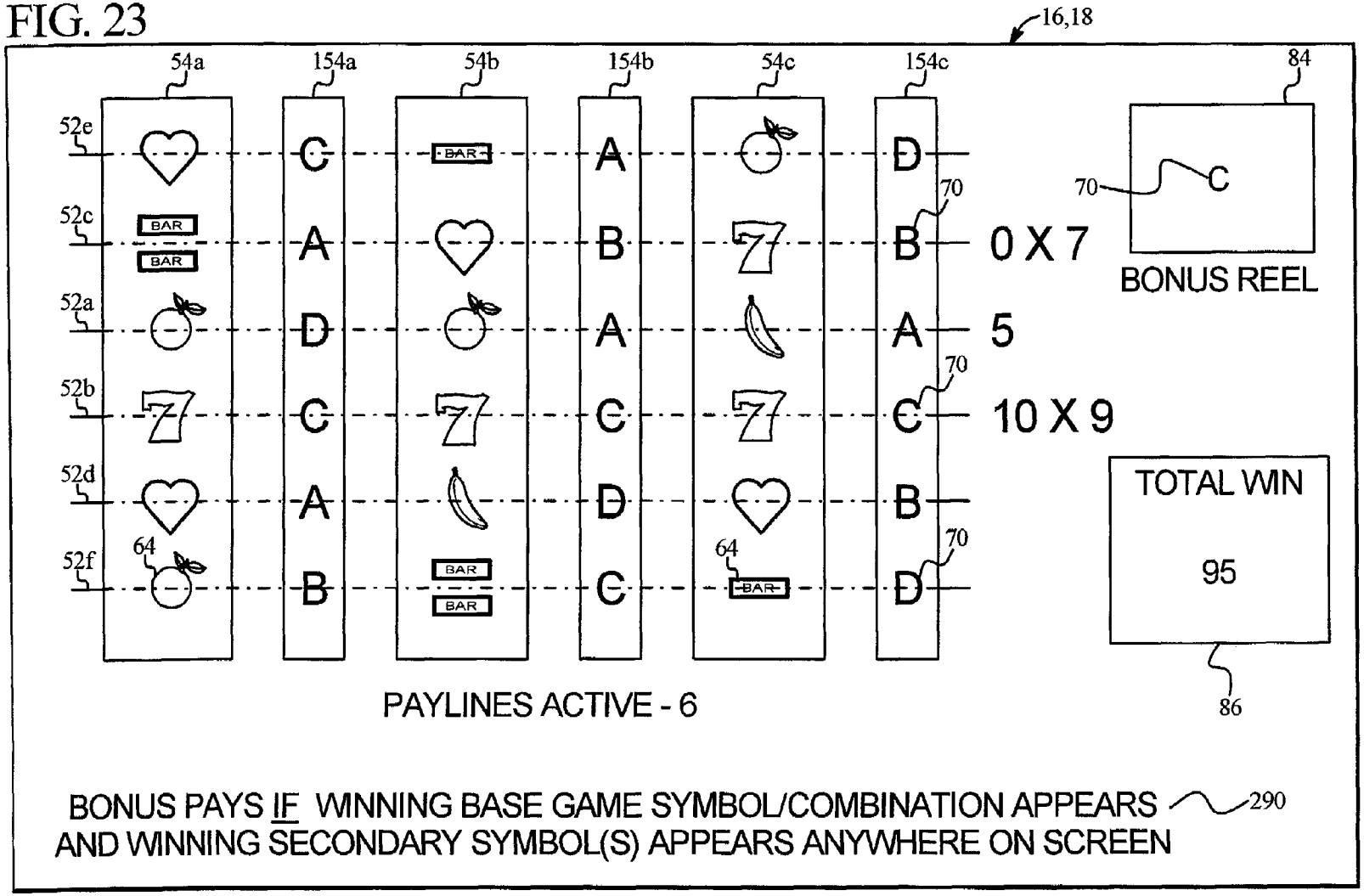

FIG. 23 illustrates another alternative embodiment. Audio, visual or audiovisual message 290 informs the player that the bonus is paid if the player obtains a winning base game symbol combination and a paying secondary symbol combination 270 appearing anywhere on the main game screen 16 or 18. Here, gaming device 10 generates base game wins along paylines 52*a* and 52*b* as above. Gaming device 10 does not generate a base game win along payline 52*c*.

As illustrated, all six paylines have been activated. The secondary symbol generation in FIG. 23 yields (i) an ×9 multiplier for one of the "C, C, C, C" combinations 270 of the paytable of FIG. 20 appearing in connection with payline 52*a* and reel 84, and (ii) an ×7 multiplier for one of the "A, B, B, C" combinations 270 of the paytable of FIG. 20 appearing in connection with non-winning payline 52*c* and reel 84. Because gaming device 10 generated base game wins along paylines 52*a* and 52*b* (only one win needed), the player also wins the bonus associated with the "A, B, B, C" combination 270 of payline 52*c* and reel 84. It should be appreciated that because the "A, B, B, C" bonus is a multiplier that multiplies a line, no bonus is paid in connection with payline 52*c* because payline 52*c* has not generated a base game win. As seen in total win meter 86, the total win is ninety-five credits.

In an alternative embodiment, awards 76 are not displayed in connection with secondary symbols 70 on reel 84. The bonus pays are however maintained according to a paytable the same or similar to that of FIG. 14. In any case, a particular secondary symbol(s) 70 on reel 84 can complete (i) a particular combination 270 with different potential pays or (ii) multiple combinations 270 with different pays. In an alternative arrangement, only one bonus pay exists for each combination 270. In the illustrated embodiment, once a particular combination 270 is generated, a second random determination is made to select which pay for that combination is provided. That second random determination may be weighted. For example, the "C, C, C, C" combination may be weighted as follows: ×3 (0.15), ×5 (0.20), ×7 (0.30), ×9 (0.20), and +5 (0.15). As discussed above, the combinations 270 may be weighted differently as well. Further alternatively, the paytable may be weighted as a whole with each payout receiving an absolute fraction of the whole. Here, only on random determination need be made.

Figure 24:
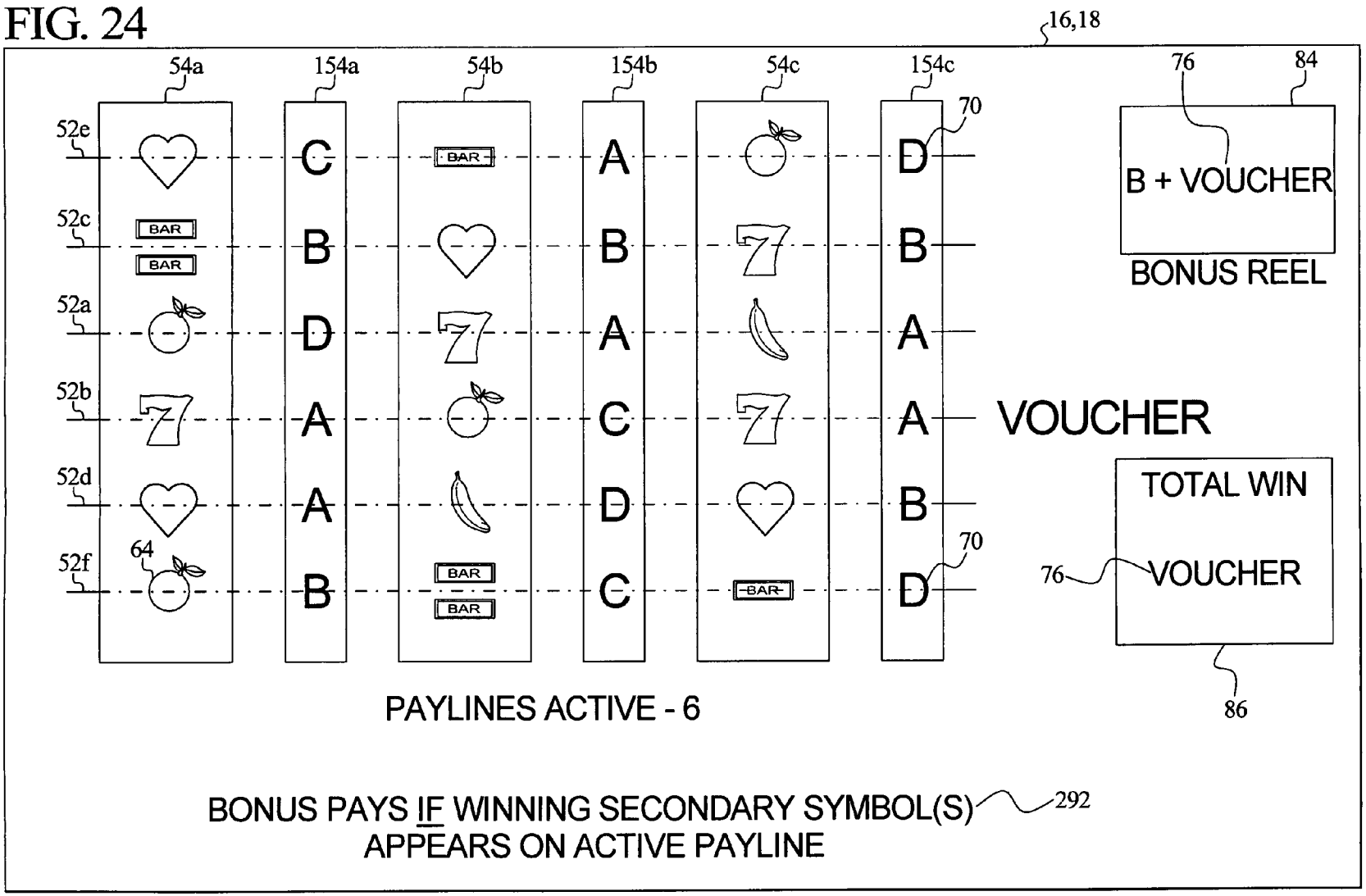

FIG. 24 illustrates a further alternative embodiment. The message 292 informs the player that a bonus is paid if a paying secondary symbol 270 is generated along any active payline. A voucher is provided from one of the "A, C, A, B" paying combinations 270 of the paytable of FIG. 20 appearing along payline 52*b* and reel 84 even though no base game win occurs along any of the six paylines 52*a* to 52*f*. Importantly, however, all six paylines have been activated as seen in display device 16 or 18. As a result, payline 52*b* is active. Because only one combination 270 ending in secondary symbol "B" is generated in FIG. 24, the voucher payout 76 can be displayed in reel or display 84. Alternatively, the payouts 76 for each of the combinations 270 ending on secondary symbol "B" is a voucher, so that voucher 76 can also be displayed in reel or display 84 no matter which of the combinations ending in the letter "B" is generated. As seen in total win meter 86, the total win is a voucher. It should be appreciated that a bonus multiplier would yield no award if no base game win is generated.

Figure 25:
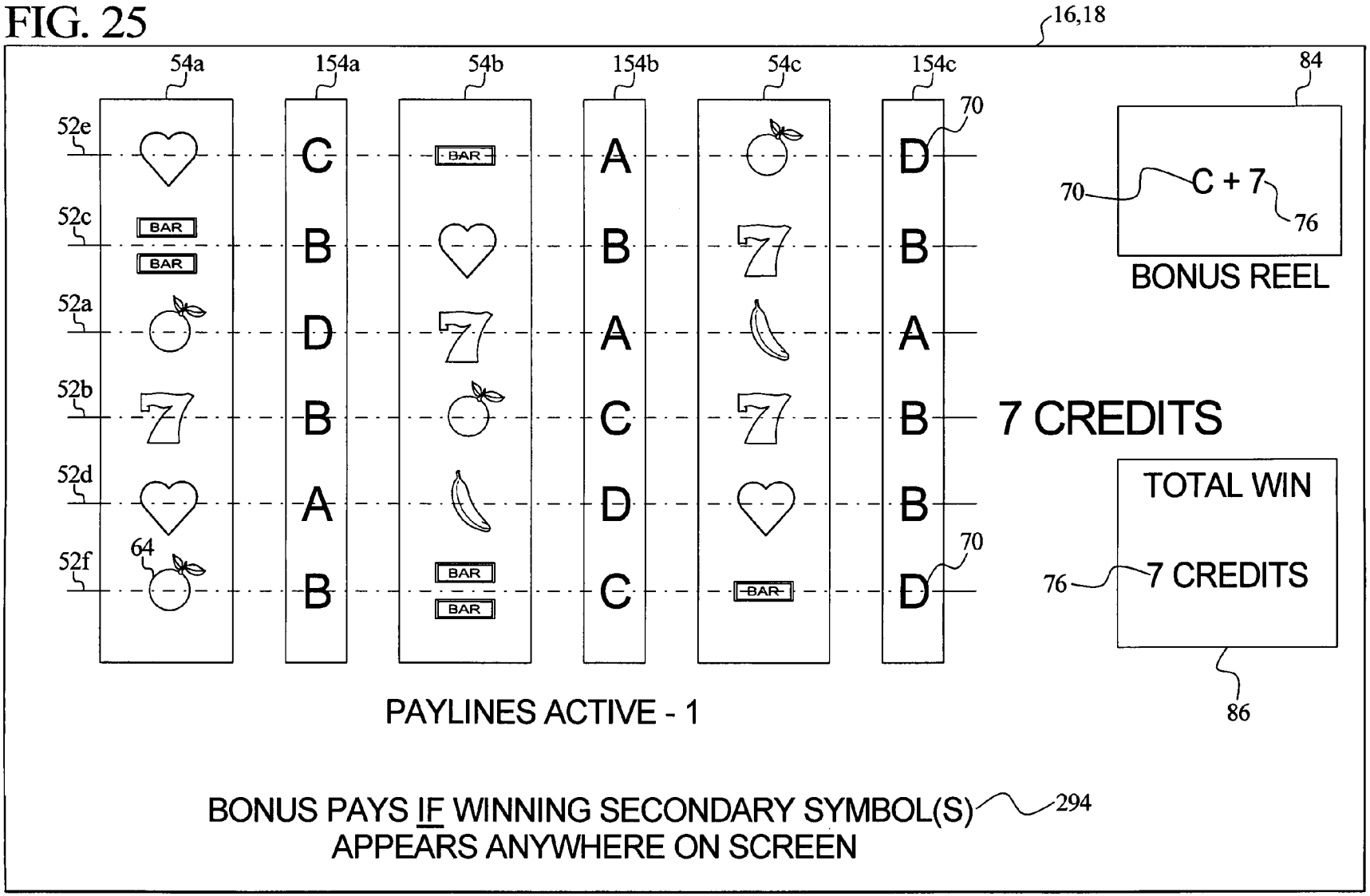

FIG. 25 illustrates yet a further alternative embodiment. Message 294 indicates that a bonus is paid if a secondary winning combination appears along any payline, regardless of whether a base game win has occurred and regardless of how many paylines the player has played. Seven credits are provided from the "B, C, B, C" paying combination 270 appearing along payline 52*b* and reel 84 even though no base game win occurs along any of the six paylines 52*a* to 52*f*. However, only payline 52*a* is active for the base game generation. As a result, payline 52*b* is not active. Even so, a bonus from the secondary symbols 70 is provided. As seen in total win meter 86, the total win is seven credits. It should be appreciated again that a bonus multiplier would yield no award if no base game win is generated.

It should be appreciated that many game combinations are provided when all the combinations of FIG. 8 are combined with all the combinations of FIGS. 21 to 25. The present invention contemplates providing a game having any suitable combination between the embodiments of FIG. 8 and the embodiments of FIGS. 21 to 25.

It should also be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area including a generated game symbol from a set of game symbols, wherein at least one of the symbol display areas includes at least one secondary symbol displayed in association with at least one of the generated game symbols, said at least one secondary symbol generated from a different pool of secondary symbols;

(b) evaluate the generated game symbols to determine whether a primary payout from a designated game symbol/symbol combination has been generated;

(c) randomly generate and display a secondary symbol from the different pool of secondary symbols in a secondary symbol display area, wherein said random generation of the secondary symbol is separate from the generation of the game symbol of each symbol display area, and wherein the secondary symbol display area is displayed apart from any of the symbol display areas; and (d) provide a secondary payout if the generated secondary symbol of the secondary symbol display area and any of the secondary symbols associated with any of the game symbols form a designated secondary symbol combination.

2. The gaming device of claim 1, wherein the game is a slot game, wherein the designated game symbol/symbol combination is generated along a payline, and wherein when executed by the at least one processor, said plurality of instructions cause the at least one processor to provide the secondary payout if the generated secondary symbol of the secondary symbol display area and the secondary symbol associated with any of the game symbols generated along the payline form the designated secondary symbol combination.

3. The gaming device of claim 1, wherein the game is a slot game including a plurality of paylines, and wherein when executed by the at least one processor, said plurality of instructions cause the at least one processor to provide the secondary payout if the generated secondary symbol of the secondary symbol display area and the secondary symbol associated with any of the game symbols generated along any of the paylines form the designated secondary symbol combination.

4. The gaming device of claim 3, wherein the primary payout includes contributions from designated game symbols/symbol combinations occurring on multiple ones of the paylines.

5. The gaming device of claim 1, wherein the designated game symbol/symbol combination is a first designated game symbol/symbol combination and the secondary payout is a first secondary payout, and which includes a second designated game symbol/symbol combination, and wherein when executed by the at least one processor, said plurality of instructions cause the at least one processor to provide a second secondary payout if the generated secondary symbol of the secondary symbol display area and the secondary symbol associated with the second designated game symbol/symbol combination form a second designated secondary symbol combination.

6. The gaming device of claim 5, wherein the first and second designated game symbols/symbol combinations occur along one of: a plurality of slot machine paylines or a plurality of hands of multi-hand poker.

7. The gaming device of claim 1, wherein the game is a poker game, wherein the designated symbol/symbol combination is generated in a hand of card game symbols, and wherein when executed by the at least one processor, said plurality of instructions cause the at least one processor to provide the secondary payout if the generated secondary symbol of the secondary symbol display area and the secondary symbol associated with any of the card game symbols of the hand form the designated secondary symbol combination.

8. The gaming device of claim 1, wherein the game is a poker game having a plurality of hands of card symbols, and wherein when executed by the at least one processor, said plurality of instructions cause the at least one processor to provide the secondary payout if the generated secondary symbol of the secondary symbol display area and the secondary symbol associated with any of the card game symbols generated on any of the hands form the designated symbol combination.

9. The gaming device of claim 8, wherein the primary payout includes contributions from designated card game symbols/symbol combinations occurring on multiple ones of the hands.

10. The gaming device of claim 1, wherein the set of game symbols is shared by and displayable on each of the symbol display areas.

11. The gaming device of claim 1, wherein the set of game symbols includes at least one game symbol uniquely displayed on less than all the display areas.

12. The gaming device of claim 1, wherein the secondary payout is a modification of the primary payout.

13. The gaming device of claim 1, wherein the designated secondary symbol combination includes a match between the secondary symbol of the secondary symbol display area and the secondary symbol associated with the game symbol.

14. The gaming device of claim 1, wherein the secondary payout includes a multiplier, a number of credits, a number of free spins, a scatter pay, a voucher or any combination thereof.

15. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area including at least one generated game symbol from a set of game symbols, wherein at least one of the symbol display areas includes at least one secondary symbol displayed in association with at least one of the generated game symbols, said at least one secondary symbol generated from a different pool of secondary symbols;

(b) evaluate the generated game symbols to determine whether a primary payout from a designated game symbol/symbol combination has been generated;

(c) randomly generate and display a secondary symbol from the different pool of secondary symbols in a secondary symbol display area, wherein said random generation of the secondary symbol is separate from the generation of the game symbol of each symbol display area, and wherein the secondary symbol display area is displayed apart from any of the symbol display areas; and (d) provide a secondary payout if the generated secondary symbol of the secondary symbol display area matches any of the secondary symbols associated with any of the game symbols.

16. The gaming device of claim 15, wherein when executed by the at least one processor, said plurality of instructions cause the at least one processor to provide the secondary payout only if the game symbol associated with the secondary symbol is a designated game symbol or part of a designated game symbol combination.

17. The gaming device of claim 15, wherein when executed by the at least one processor, said plurality of instructions cause the at least one processor to modify the payout only if the game symbol associated with the secondary symbol appears on (i) a slot machine payline upon which a designated game symbol/game symbol combination appears or (ii) a poker game hand upon which a designated card game symbol/symbol combination occurs.

18. The gaming device of claim 15, wherein the designated game symbol/symbol combination is a first designated game symbol/symbol combination, and which includes a second designated game symbol/symbol combination yielding a second primary payout generated from the set of game symbols, and wherein when executed by the at least one processor, said plurality of instructions cause the at least one processor to provide a second secondary payout if the generated secondary symbol of the secondary symbol display area matches a secondary symbol associated with one of the game symbols.

19. The gaming device of claim 18, wherein the first and second designated game symbols/symbol combinations occur along one of: a plurality of slot machine paylines or a plurality of hands of multi-hand poker.

20. The gaming device of claim 15, wherein the secondary payout is a modification of the primary payout.

21. The gaming device of claim 15, wherein the secondary payout includes a multiplier, a number of credits, a number of free spins, a scatter pay, a voucher or any combination thereof.

22. The gaming device of claim 15, wherein the secondary symbols are each associated with a modifier, and wherein the secondary payout is a modification of the primary payout by the modifier associated with the matching secondary symbol of the secondary symbol display area.

23. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area including a generated game symbol from a set of game symbols, wherein at least one of the symbol display areas includes at least one secondary symbol displayed in association with at least one of the generated game symbols, said at least one secondary symbol generated from a different pool of secondary symbols;

(b) evaluate the generated game symbols to determine whether a payout from a designated game symbol/symbol combination has been generated;

(c) randomly generate and display a secondary symbol from the different pool of secondary symbols in a secondary symbol display area, wherein said random generation of the secondary symbol is separate from the generation of the game symbol of each symbol display area, and wherein the secondary symbol display area is displayed apart from any of the symbol display areas; and (d) provide an award to a player if the generated secondary symbol of the secondary symbol display area matches any of the secondary symbols associated with any of the paying game symbol/symbol combinations.

24. The gaming device of claim 23, wherein the award includes (i) a modification of the payout or (ii) a stand alone award.

25. The gaming device of claim 23, wherein the designated game symbols/symbol combinations occur along one of: a plurality of slot machine paylines or a plurality of hands of multi-hand poker.

26. The gaming device of claim 23, wherein the award is a first award and the generated secondary symbol is a first generated secondary symbol and which includes a second award provided to the player if a second generated secondary symbol of the secondary symbol display area matches a second secondary symbol associated with the designated game symbol/symbol combination.

27. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area displaying a generated game symbol from a set of game symbols, wherein at least one of the symbol display areas includes at least one secondary symbol displayed in association with at least one of the generated game symbols, said at least one secondary symbol generated from a different pool of secondary symbols;

(b) evaluate the generated game symbols to determine whether a payout from a designated game symbol/symbol combination has been generated;

(c) randomly generate and display a secondary symbol from the different pool of secondary symbols in a secondary symbol display area, wherein said random generation of the secondary symbol is separate from the generation of the game symbol of each symbol display area, and wherein the secondary symbol display area is displayed apart from any of the symbol display areas; and (d) provide an award to a player if the generated secondary symbol of the secondary symbol display area matches any of the secondary symbols associated with any one of the generated game symbols.

28. The gaming device of claim 27, wherein the award includes (i) a modification of the payout or (ii) a stand alone award.

29. The gaming device of claim 27, wherein the designated game symbols/symbol combinations occur along one of: a plurality of slot machine paylines or a plurality of hands of multi-hand poker.

30. The gaming device of claim 27, wherein the award is a first award and the generated secondary symbol is a first generated secondary symbol and which includes a second award provided to the player if a second generated secondary symbol of the secondary symbol display area matches a second secondary symbol associated with the designated game symbol/symbol combination.

31. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area including a generated game symbol from a set of game symbols, wherein the generated game symbols potentially yield a designated symbol/symbol combination and an associated primary payout, and wherein at least one of the symbol display areas includes at least one secondary symbol displayed as associated with at least one of the generated game symbols, the at least one secondary symbol being generated from a different pool of secondary symbols;

(b) randomly generate and display in a separate secondary symbol display area a secondary symbol from the different pool of secondary symbols, wherein said random generation of the secondary symbol is separate from the generation of the game symbol of each symbol display area; and (c) determine whether the generated secondary symbol of the separate secondary symbol display area and any of the displayed secondary symbols associated with any of the generated game symbols yield a designated secondary symbol/symbol combination and an associated secondary payout.

32. The gaming device of claim 31, wherein the secondary payout is selected from the group consisting of: a multiplication of the primary payout, an addition of credits to the primary payout, an addition of a non-monetary award to the primary payout, and any combination thereof.

33. The gaming device of claim 31, wherein the designated secondary symbol/symbol combination must appear on an active payline to generate the secondary payout.

34. The gaming device of claim 31, wherein the designated game symbol/symbol combination and the designated secondary symbol/symbol combination must each appear on a same payline to generate the secondary payout.

35. The gaming device of claim 31, wherein the designated game symbol/symbol combination and the designated secondary symbol/symbol combination must each appear at a same one or more paystop to generate the secondary payout.

36. The gaming device of claim 31, wherein each secondary symbol is distinguished via its shape, its indicia, its color, its pattern or any combination thereof.

37. The gaming device of claim 31, wherein the at least one memory device stores a plurality of designated game symbol/symbol combinations and a plurality of designated secondary symbol/symbol combinations.

38. The gaming device of claim 31, wherein the symbol display areas include reels, and wherein the game symbols and the secondary symbols are displayed on the reels.

39. The gaming device of claim 38, wherein the reels are simulated on the display device and the game symbols are generated randomly and separately from the secondary symbols.

40. The gaming device of claim 31, wherein the symbol display areas include game reels and secondary reels, and wherein the game symbols are displayed on the game reels and the secondary symbols are displayed on the secondary reels.

41. The gaming device of claim 40, wherein the game reels and the secondary reels have a characteristic selected from the group consisting of: being simulated, being positioned concentrically, and being positioned adjacently.

42. The gaming device of claim 40, wherein each of the secondary reels is positioned inside of one of the game reels, and wherein the game reels enable secondary symbols on the secondary reels to be seen by providing (i) a clear background or (ii) a series of openings.

43. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area including a generated game symbol from a set of game symbols, wherein the generated game symbols potentially yield a designated symbol/symbol combination and an associated primary payout, and wherein at least one of the symbol display areas includes at least one secondary symbol displayed as associated with at least one of the generated game symbols, the at least one secondary symbol being generated from a different pool of secondary symbols, the game symbols and the secondary symbols being generated randomly and separately from one another;

(b) randomly generate and display in a separate secondary symbol display area a secondary symbol from the different pool of secondary symbols, wherein said random generation of the secondary symbol is separate from the generation of the game symbol of each symbol display area; and (c) determine whether the generated secondary symbol of the separate secondary symbol display area and any of the displayed secondary symbols associated with any of the generated game symbols yield a designated secondary symbol/symbol combination and an associated secondary payout.

44. The gaming device of claim 43, wherein the game symbols are generated on game reels separate from secondary reels upon which the secondary symbols are generated.

45. The gaming device of claim 44, wherein the game reels and the secondary reels have a characteristic selected from the group consisting of: being simulated, being positioned concentrically, and being positioned adjacently.

46. The gaming device of claim 44, wherein each of the secondary reels is positioned inside of one of the game reels, and wherein the game reels enable secondary symbols on the secondary reels to be seen by providing (i) a clear background or (ii) a series of openings.

47. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area including a generated game symbol from a set of game symbols, wherein the generated game symbols potentially yield a designated symbol/symbol combination and an associated primary payout, and wherein at least one of the symbol display areas includes at least one secondary symbol displayed as associated with at least one of the generated game symbols, the at least one secondary symbol being selected from a different pool of secondary symbols;

(b) randomly generate and display in a separate secondary symbol display area a secondary symbol from the different pool of secondary symbols, wherein said random generation of the secondary symbol is separate from the generation of the game symbol in each symbol display area; and (c) determine whether the generated secondary symbol of the separate secondary symbol display area and any of the displayed secondary symbols associated with any of the generated game symbols yield a designated secondary symbol/symbol combination, and an associated secondary payout, wherein the secondary payout is selected according to a paytable of secondary payouts associated with the designated secondary symbol/symbol combination.

48. The gaming device of claim 47, wherein the game is selected from the group consisting of: slot, poker, and keno.

49. A gaming device comprising:

at least one processor;

at least one display device at least one input device; and at least one memory device which stores a plurality of instructions, which when executed by the at least one processor, for each play of a game, cause the at least one processor to operate with the at least one display device and the at least one input device to:

(a) display a generated game symbol from a set of game symbols in each of a plurality of symbol display areas, the generated game symbols potentially yielding a designated symbol/symbol combination and an associated primary payout;

(b) display at least one secondary symbol from a different pool of secondary symbols in at least one of the symbol display areas; and (c) randomly generate and display a secondary symbol from the different pool of secondary symbols in a secondary symbol display area, wherein said random generation of the secondary symbol is separate from the generation of the game symbol of each symbol display area, wherein the secondary symbol display area is displayed apart from any of the symbol display areas, and wherein any of the displayed secondary symbols including the secondary symbol from the secondary symbol display area potentially yields a designated secondary symbol/symbol combination and an associated secondary payout.

50. The gaming device of claim 49, wherein the secondary payout is selected from the group consisting of: a multiplication of the primary payout, an addition of credits to the primary payout, an addition of a non-monetary award to the primary payout, and any combination thereof.

51. The gaming device of claim 49, wherein the designated secondary symbol/symbol combination must appear on an active payline to generate the secondary payout.

52. The gaming device of claim 49, wherein the designated game symbol/symbol combination and a portion of the designated secondary symbol/symbol combination must each appear on a same payline to generate the secondary payout.

53. The gaming device of claim 49, wherein the designated game symbol/symbol combination and a portion of the designated secondary symbol/symbol combination must each appear at a same one or more paystop to generate the secondary payout.

54. The gaming device of claim 49, wherein each secondary symbol is distinguished via its shape, its indicia, its color, its pattern or any combination thereof.

55. The gaming device of claim 49, wherein the at least one memory device stores a plurality of designated game symbol/symbol combinations and a plurality of designated secondary symbol/symbol combinations.

56. The gaming device of claim 49, wherein the symbol display areas include reels, and wherein the game symbols and the secondary symbols not displayed of the secondary symbol display area are displayed on the reels.

57. The gaming device of claim 56, wherein the reels are simulated on the display device and the game symbols are generated randomly and separately from the secondary symbols.

58. The gaming device of claim 49, wherein the symbol display areas include game reels and secondary reels, and wherein (i) the game symbols are displayed on the game reels and (ii) the secondary symbols not displayed of the secondary symbol display area are displayed on the secondary reels.

59. The gaming device of claim 58, wherein the game reels and the secondary reels have a characteristic selected from the group consisting of: being simulated, being positioned concentrically, and being positioned adjacently.

60. The gaming device of claim 58, wherein each of the secondary reels is positioned inside of one of the game reels, and wherein the game reels enable secondary symbols on the secondary reels to be seen by providing (i) a clear background or (ii) a series of openings.

61. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area displaying a generated game symbol from a set of game symbols, the generated game symbols potentially yielding a designated symbol/symbol combination and an associated primary payout and to cause a display of at least one secondary symbol from a different pool of secondary symbols in at least one of the symbol display areas; and (b) randomly generate and display a secondary symbol from the different pool of secondary symbols in a secondary symbol display area, wherein said random generation of the secondary symbol is separate from the generation of the game symbol of each symbol display area, wherein the secondary symbol display area is independent from any of the symbol display areas, and wherein any of the displayed secondary symbols including the secondary symbol from the secondary symbol display area potentially yields a designated secondary symbol/symbol combination and an associated secondary payout;

wherein the game symbols and the secondary symbols are generated randomly and separately from each other.

62. The gaming device of claim 61, wherein the game symbols are generated on game reels separate from secondary reels upon which various ones of the secondary symbols are generated.

63. The gaming device of claim 61, wherein the game reels and the secondary reels have a characteristic selected from the group consisting of: being simulated, being positioned concentrically, and being positioned adjacently.

64. The gaming device of claim 61, wherein each of the secondary reels is positioned inside of one of the game reels, and wherein the game reels enable secondary symbols on the secondary reels to be seen by providing (i) a clear background or (ii) a series of openings.

65. A gaming device comprising:

at least one processor;

a display device;

at least one input device; and at least one memory device which stores a plurality of instructions, which when executed by the at least one processor, for each play of a game, cause the at least one processor to operate with the display device and the at least one input device to:

(a) display a plurality of symbol display areas, each symbol display area including a generated game symbol from a set of game symbols, the generated game symbols potentially yielding a designated symbol/symbol combination and an associated payout and to cause a display of at least one secondary symbol from a different pool of secondary symbols in at least one of the symbol display areas; and (b) randomly generate and display a secondary symbol from the different pool of secondary symbols in a secondary symbol display area, wherein said random generation of the secondary symbol is separate from the generation of the game symbol of each symbol display area, wherein the secondary symbol display area is displayed apart from any of the symbol display areas, and wherein any of the displayed secondary symbols including the secondary symbol from the secondary symbol display area potentially yields a designated secondary symbol/symbol combination and an associated secondary payout;

wherein the secondary payout is selected according to a paytable of secondary payouts associated with the designated secondary symbol/symbol combination.

66. The gaming device of claim 65, wherein the game is selected from the group consisting of: slot, poker, and keno.

* * * * *

UNITED STATES PATENT AND TRADEMARK OFFICE

CERTIFICATE OF CORRECTION

PATENT NO. : 7,591,724 B2
APPLICATION NO. : 10/957013
DATED : September 22, 2009
INVENTOR(S) : Anthony J. Baerlocher It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 581 days.

Signed and Sealed this

Twenty-first Day of September, 2010

David J. Kappos

David J. Kappos
*Director of the United States Patent and Trademark Office*